US012624869B2

(12) United States Patent
Takeichi et al.

(10) Patent No.: US 12,624,869 B2
(45) Date of Patent: May 12, 2026

(54) HEAT PUMP CYCLE DEVICE

(71) Applicant: DENSO CORPORATION, Kariya-city (JP)

(72) Inventors: Kota Takeichi, Kariya-city (JP); Atsushi Inaba, Kariya-city (JP); Yuichi Kami, Kariya-city (JP); Kengo Sugimura, Kariya-city (JP); Daiki Kato, Kariya-city (JP)

(73) Assignee: DENSO CORPORATION, Kariya-city (JP)

( * ) Notice: Subject to any disclaimer, the term of this patent is extended or adjusted under 35 U.S.C. 154(b) by 144 days.

(21) Appl. No.: 18/602,846

(22) Filed: Mar. 12, 2024

(65) Prior Publication Data

US 2024/0219086 A1 Jul. 4, 2024

Related U.S. Application Data

(63) Continuation of application No. PCT/JP2022/033871, filed on Sep. 9, 2022.

(30) Foreign Application Priority Data

Sep. 24, 2021 (JP) ..... 2021-155295

(51) Int. Cl.
*F25B 41/20* (2021.01)
*F25B 30/02* (2006.01)
*F25B 41/42* (2021.01)

(52) U.S. Cl.
CPC ..... *F25B 41/20* (2021.01); *F25B 30/02* (2013.01); *F25B 41/42* (2021.01)

(58) Field of Classification Search
CPC .. F25B 1/00; F25B 13/00; F25B 30/02; F25B 41/20; F25B 41/39; F25B 41/42; F25B 49/02
See application file for complete search history.

(56) References Cited

U.S. PATENT DOCUMENTS

2001/0022090 A1 9/2001 Takano et al.
2002/0023451 A1* 2/2002 Kuroda ..... F25B 49/022 62/228.4
2009/0205355 A1 8/2009 Mihara
(Continued)

FOREIGN PATENT DOCUMENTS

JP H10089778 A 4/1998
JP 2001260645 A 9/2001
(Continued)

*Primary Examiner* — Henry T Crenshaw
(74) *Attorney, Agent, or Firm* — Harness, Dickey & Pierce, P.L.C.

(57) ABSTRACT

A heat pump cycle device includes a compressor, a branching unit, a heating unit, a heating-unit-side depressurizing unit, a bypass passage, a bypass flow-rate adjusting unit, a mixing unit, and a target pressure difference determining unit. The target pressure difference determining unit determines a target pressure difference as a target value of a pressure difference determined by subtracting a suctioned refrigerant pressure from a discharge refrigerant pressure. An operation of at least one of the compressor, the heating-unit-side depressurizing unit, or the bypass flow-rate adjusting unit is controlled so that the pressure difference comes close to the target pressure difference.

6 Claims, 13 Drawing Sheets

(56) References Cited

U.S. PATENT DOCUMENTS

| | | | |
|---|---|---|---|
| 2017/0138645 | A1 | 5/2017 | Sakima et al. |
| 2018/0156509 | A1 | 6/2018 | Tada |
| 2022/0275982 | A1 | 9/2022 | Mieda et al. |

FOREIGN PATENT DOCUMENTS

| | | | | |
|---|---|---|---|---|
| JP | 2006266522 | A | | 10/2006 |
| JP | 2008164288 | A | | 7/2008 |
| JP | 2008224189 | | * | 9/2008 |
| JP | 2008224189 | A | | 9/2008 |
| JP | 2018091536 | A | | 6/2018 |
| JP | 2021156567 | A | | 10/2021 |
| WO | WO-2015174054 | A1 | | 11/2015 |

* cited by examiner

HOT GAS HEATING MODE

HOT GAS HEATING MODE

HOT GAS DEHUMIDIFYING-HEATING MODE

HOT GAS DEHUMIDIFYING-HEATING MODE

WARMING-UP-ONLY MODE

WARMING-UP-ONLY MODE

DEHUMIDIFYING MODE

DEHUMIDIFYING MODE

HEAT PUMP CYCLE DEVICE

CROSS REFERENCE TO RELATED APPLICATIONS

The present application is a continuation application of International Patent Application No. PCT/JP2022/033871 filed on Sep. 9, 2022, which designated the U.S. and claims the benefit of priority from Japanese Patent Application No. 2021-155295 filed on Sep. 24, 2021.

TECHNICAL FIELD

The present disclosure relates to a heat pump cycle device for heating a heating target by using heat generated by a work of a compressor.

BACKGROUND

Conventionally, a heat pump cycle device is applied to an air conditioner for a vehicle. In the heat pump cycle device, in a heating mode of heating the inside of a vehicle compartment, a refrigerant circuit may be switched to a hot-gas heater circuit.

SUMMARY

A heat pump cycle device according to at least one embodiment of the present disclosure includes a compressor and a target pressure difference determining unit. The compressor is configured to compress a refrigerant and discharge the refrigerant. The target pressure difference determining unit is configured to determine a target pressure difference that is a target value of a pressure difference determined by subtracting a suctioned refrigerant pressure of the refrigerant drawn into the compressor from a discharge refrigerant pressure of the refrigerant discharged from the compressor. An operation of the compressor may be controlled so that the pressure difference comes close to the target pressure difference.

BRIEF DESCRIPTION OF DRAWINGS

The above object, other objects, features, and advantages of the present disclosure will become more apparent from the following detailed description with reference to the appended drawings.

DETAILED DESCRIPTION

Figure 1:
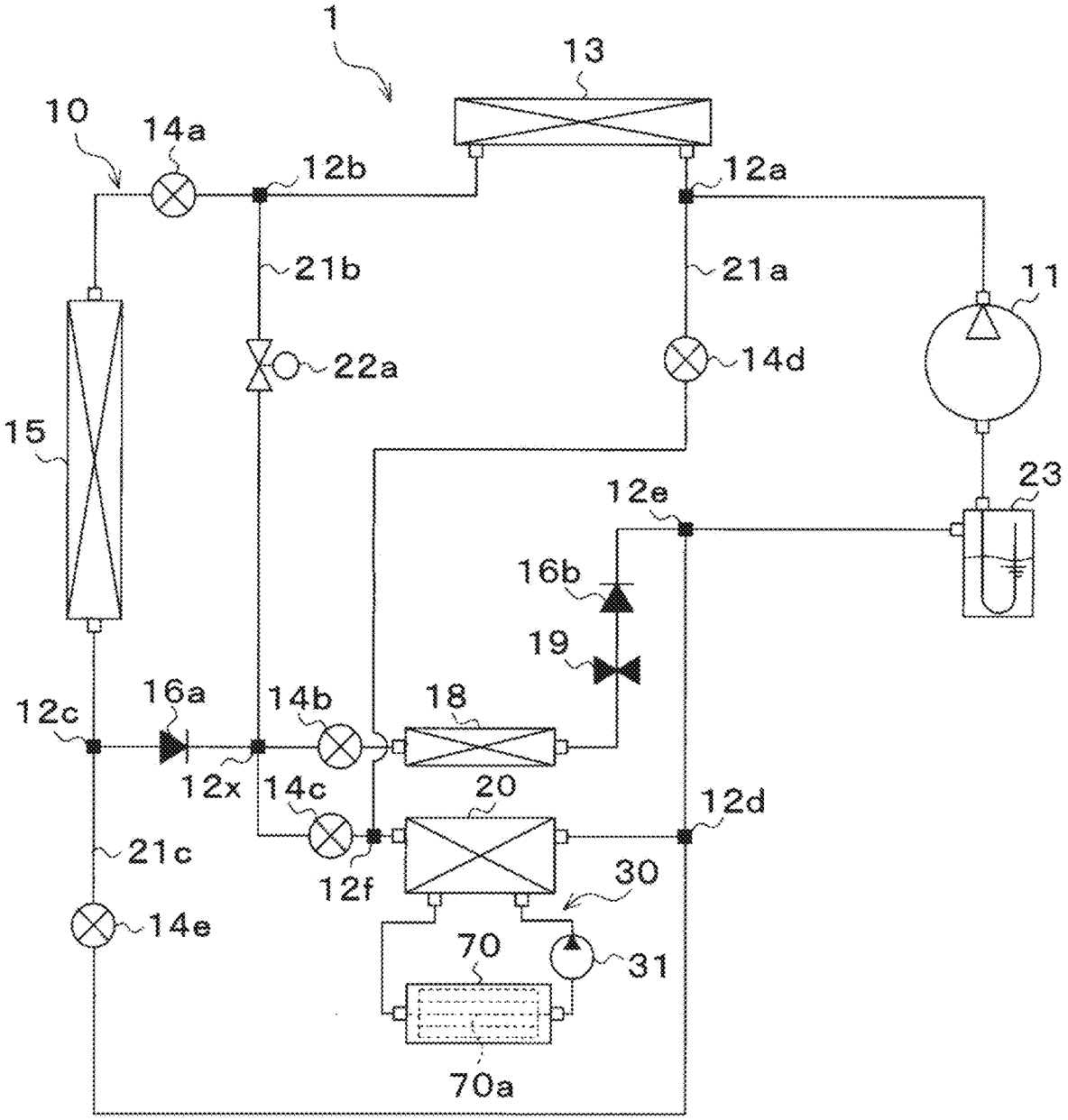
FIG. 1 is a schematic general configuration diagram of an air conditioner for a vehicle of a first embodiment.

To begin with, examples of relevant techniques will be described. A heat pump cycle device according to a comparative example is applied to an air conditioner for a vehicle. In the heat pump cycle device, in a heating mode of heating the inside of a vehicle compartment, a refrigerant circuit is switched to a hot-gas heater circuit. In the hot-gas heater circuit, refrigerant discharged from a compressor is circulated through a fixed throttle, an inside heat exchanger, and the suction port side of the compressor in this order.

In the heat pump cycle device of the comparative example, in the heating mode, blown air that is blown into the vehicle compartment is heated via heat exchange in the inside heat exchanger between the refrigerant depressurized by the fixed throttle and the blown air. Therefore, in the heat pump cycle device, in the heating mode, the blown air that is a heating target is heated with heat generated by a work of a compressor without using heat absorbed from the outside air and the like.

Further, in the heat pump cycle device of the comparative example, in the heating mode, a discharge refrigerant pressure that is a pressure of the refrigerant discharged from the compressor is controlled so as to come close to a target high pressure.

However, in the heat pump cycle device of the comparative example, in the heating mode, it is not easy to adjust the capability of heating the blown air in the inside heat exchanger. The reason is that, in the heat pump cycle device of the comparative example, since the discharged refrigerant whose pressure is increased so as to be close to the target high pressure is depressurized by the fixed throttle, the pressure different of the cycle is not easily changed.

The capability of heating the blown air in the inside heat exchanger can be defined by an integration value of an enthalpy difference and a flow rate (mass flow rate) of the refrigerant passing through the inside heat exchanger. The enthalpy difference is obtained by subtracting an enthalpy of the refrigerant on the outlet side of the inside heat exchanger from an enthalpy of the refrigerant on the inlet side of the inside heat exchanger.

Consequently, in the operation mode of heating the blown air with the heat generated by the work of the compressor as in the heating mode of the comparative example, an amount of the work of the compressor corresponds to the capability of heating the blown air in the inside heat exchanger. Further, an enthalpy difference of the refrigerant in the inside heat exchanger is determined by the pressure difference in the cycle. Therefore, when the pressure difference in the cycle is not easily changed, the capability of heating the blown air is not easily changed.

In response to these difficulties, means of employing a variable throttle mechanism in place of the fixed throttle of the heat pump cycle device of the comparative example can be considered. Then, the pressure difference in the cycle can be adjusted by changing the throttle opening of the variable throttle mechanism, and the capability of heating the blown air in the inside heat exchanger can be adjusted.

In the heat pump cycle of the comparative example, however, even when the variable throttle mechanism is employed, if the work amount of the compressor cannot be adjusted to a heat amount which is proper to heat the blown air, it is difficult to stably operate the cycle.

For example, in the heat pump cycle device of the comparative example employing the variable throttle mechanism, it is assumed that the refrigerant discharging capability of the compressor is increased in order to increase the blown air heating capability in the inside heat exchanger. When the refrigerant discharging capability of the compressor is increased, the discharge refrigerant pressure rises. It is consequently considered to increase the throttle opening of the variable throttle mechanism so that the discharge refrigerant pressure comes close to the target high pressure.

When the throttle opening of the variable throttle mechanism is increased, however, the pressure of the refrigerant which flows in the inside heat exchanger rises, so that the pressure difference decreases. Due to this, the blown air heating capability in the inside heat exchanger cannot be sufficiently increased. As a result, the refrigerant discharge capability of the compressor has to be further increased, and the cycle cannot be operated stably.

In contrast, according to the present disclosure, a heat pump cycle device can be improved in stability of operation at the time of heating a heating target.

A heat pump cycle device according to a first aspect of the present disclosure includes a compressor, a branching unit, a heating unit, a heating-unit-side depressurizing unit, a bypass passage, a bypass flow-rate adjusting unit, a mixing unit and a target pressure difference determining unit.

The compressor is configured to compress a refrigerant and discharge the refrigerant. The branching unit is configured to branch a flow of the refrigerant discharged from the compressor. The heating unit is configured to heat a heating target with a heating source that is one of refrigerants branched by the branching unit. The heating-unit-side depressurizing unit is configured to depressurize the refrigerant which has flowed out from the heating unit. The bypass passage is configured to allow another of the refrigerants branched by the branching unit to flow toward a suction port side of the compressor through the bypass passage. The bypass flow-rate adjusting unit is configured to adjust a flow rate of the refrigerant passing through the bypass passage. The mixing unit configured to allow the refrigerant which has flowed out from the bypass flow-rate adjusting unit and the refrigerant which has flowed out from the heating-unit-side depressurizing unit to mix with each other and flow toward the suction port side of the compressor. The target pressure difference determining unit is configured to determine a target pressure difference that is a target value of a pressure difference determined by subtracting a suctioned refrigerant pressure of the refrigerant drawn into the compressor from a discharge refrigerant pressure of the refrigerant discharged from the compressor.

An operation of at least one of the compressor, the heating-unit-side depressurizing unit, or the bypass flow-rate adjusting unit is controlled so that the pressure difference comes close to the target pressure difference.

According to the above, the operation of at least one of the compressor, the heating-unit-side depressurizing unit, or the bypass flow-rate adjusting unit is controlled so that the pressure difference comes close to the target pressure difference. Therefore, by properly determining the target pressure difference, the work amount of the compressor can be adjusted to obtain a heat amount by which a heating target can be properly heated.

As a result, in the heat pump cycle device of the first aspect, the stability of the operation at the time of heating a heating target can be improved.

A heat pump cycle device according to a second aspect of the present disclosure includes a compressor, an upstream depressurizing unit, a low-pressure heating unit, and a target pressure difference determining unit.

The compressor is configured to compress a refrigerant and discharge the refrigerant. The upstream depressurizing unit is configured to depressurize the refrigerant discharged from the compressor. The low-pressure heating unit is configured to heat a low-pressure heating target with a heating source that is the refrigerant which has flowed out from the upstream depressurizing unit and allow the refrigerant to outflow toward a suction port side of the compressor. The target pressure difference determining unit is configured to determine a target pressure difference that is a target value of a pressure difference determined by subtracting a suctioned refrigerant pressure of the refrigerant drawn into the compressor from a discharge refrigerant pressure of the refrigerant discharged from the compressor.

An operation of at least one of the compressor or the upstream depressurizing unit is controlled so that the pressure difference comes close to the target pressure difference.

According to the above, the operation of at least one of the compressor or upstream depressurizing unit is controlled so that the pressure difference comes close to the target pressure difference. Therefore, by properly determining the target pressure difference, the work amount of the compressor can be adjusted to obtain a heat amount by which a low-pressure heating target can be properly heated.

As a result, in the heat pump cycle device of the second aspect, the stability of the operation at the time of heating a heating target can be improved.

A heat pump cycle device according to a third aspect of the present disclosure includes a compressor, a high-pressure heating unit, a downstream depressurizing unit, and a target pressure difference determining unit.

The compressor is configured to compress a refrigerant and discharge the refrigerant. The high-pressure heating unit is configured to heat a high-pressure heating target with a heating source that is the refrigerant discharged from the compressor. The downstream depressurizing unit is configured to depressurize the refrigerant which has flowed out from the high-pressure heating unit and allow the refrigerant to outflow toward a suction port side of the compressor. The target pressure difference determining unit is configured to determine a target pressure difference as a target value of a pressure difference determined by subtracting a suctioned refrigerant pressure of the refrigerant drawn into the compressor from a discharge refrigerant pressure of the refrigerant discharged from the compressor.

An operation of at least one of the compressor or the downstream depressurizing unit is controlled so that the pressure difference comes close to the target pressure difference.

According to the above, the operation of at least one of the compressor or the downstream depressurizing unit is controlled so that the pressure difference comes close to the target pressure difference. Therefore, by properly determining the target pressure difference, the work amount of the compressor can be adjusted to obtain a heat amount by which a high-pressure heating target can be properly heated.

As a result, in the heat pump cycle device of the third aspect, the stability of the operation at the time of heating a heating target can be improved.

Hereinafter, multiple embodiments will be described with reference to the drawings. Elements corresponding to each other among the embodiments are assigned the same numeral and their descriptions may be omitted. When only a part of a component is described in an embodiment, the other part of the component can be relied on the component of a preceding embodiment. Furthermore, in addition to the combination of components explicitly described in each embodiment, it is also possible to combine components from different embodiments, as long as the combination poses no difficulty, even if not explicitly described.

First Embodiment

A first embodiment of a heat pump cycle device according to the present disclosure will be described with reference to FIGS. 1 to 13. In the embodiment, the heat pump cycle device according to the present disclosure is applied to an air conditioner 1 for a vehicle, which is mounted in an electric vehicle. An electric vehicle is a vehicle obtaining the driving force for travelling from an electronic motor. The air conditioner 1 for a vehicle performs air conditioning in the compartment as an air-conditioning target space and also performs temperature adjustment of an in-vehicle device. Therefore, the air conditioner 1 for a vehicle can be also called an air conditioner with an in-vehicle device temperature adjusting function or an in-vehicle device temperature adjusting device with an air-conditioning function.

In the air conditioner 1 for a vehicle, temperature adjustment of an in-vehicle device, concretely, a battery 70 is performed. The battery 70 is a secondary battery storing power which is supplied to a plurality of in-vehicle devices operated by electricity. The battery 70 is an assembled battery formed by electrically connecting a plurality of stacked battery cells in series or in parallel. The battery cell of the embodiment is a lithium ion battery.

The battery 70 generates heat at the time of operation (that is, at the time of charging/discharging). The output of the battery 70 tends to decrease at low temperature, and deterioration tends to progress at high temperature. Consequently, the temperature of the battery 70 has to be maintained within a proper temperature range (in the embodiment, 15° C. or higher and 55° C. or lower). In the electric vehicle of the embodiment, the temperature of the battery 70 is adjusted by using the air conditioner 1 for a vehicle. Obviously, an in-vehicle device as a temperature adjustment target of the air conditioner 1 for a vehicle is not limited to the battery 70.

The air conditioner 1 for a vehicle has a heat pump cycle 10, a low-temperature heating medium circuit 30, an inside air-conditioning unit 50, a control device 60, and the like.

First, the heat pump cycle 10 will be described. The heat pump cycle 10 is a refrigerant cycle of a vapor compression type, which adjusts the temperature of the air blown into the vehicle compartment and a low-temperature heating medium circulating in the low-temperature heating medium circuit 30. The heat pump cycle 10 is configured so as to be able to switch a refrigeration circuit in accordance with various operation modes which will be described later, for air conditioning in the compartment and cooling of in-vehicle devices.

The heat pump cycle 10 employs an HFO refrigerant (concretely, R1234yf) as the refrigerant. The heat pump cycle 10 is a subcritical refrigeration cycle in which the pressure of a high-pressure refrigerant does not exceed the critical pressure of the refrigerant. In the refrigerant, a refrigerant oil for making a compressor 11 lubricated is mixed. The refrigerant oil is a PAG oil having compatibility with a liquid-phase refrigerant (that is, polyalkylimide glycol oil). A part of the refrigerant oil circulates with the refrigerant in the heat pump cycle 10.

The compressor 11 intakes the refrigerant, compresses it, and discharges the resultant in the heat pump cycle 10. The compressor 11 is an electric compressor rotating a compression mechanism of a fixed amount type in which a discharge amount is fixed, by an electric motor. The rotational speed (that is, the refrigerant discharge capability) of the compressor 11 is controlled by a control signal output from the control device 60 which will be described later.

The compressor 11 is disposed in a drive device chamber formed in the front side in the compartment. As the drive device chamber, a space in which at least a part of devices used for generating/adjusting the driving force for vehicle travel (for example, an electric motor for travel) is disposed is formed.

To the discharge port of the compressor 11, an inflow port side of a first three-way joint 12*a* is connected. The first three-way joint 12 has three inflow/outflow ports which communicate with one another. As the first three-way joint 12, a joint part formed by joining a plurality of pipes or a joint part formed by providing a plurality of refrigerant passages in a metal block or a resin block can be employed.

Further, as will be described later, the heat pump cycle 10 has second to sixth three-way joints 12*b* to 12*f*. The basic configuration of each of the second to sixth three-way joints 12*b* to 12*f* is similar to that of the first three-way joint 12*a*.

When one of the three inflow/outflow ports in any of the three-way joints is used as an inflow port and the remaining two ports are used as outflow ports, the flow of the refrigerant is branched. When two of the three inflow/outflow ports are used as inflow ports and the remaining one port is used as an outflow port, the flows of the refrigerant are merged. The first three-way joint 12*a* is a branching unit branching the flow of the refrigerant discharged from the compressor 11.

To one of the outflow ports of the first three-way joint 12*a*, the refrigerant inlet side of the outlet of the inside condenser 13 is connected. To the other outflow port of the first three-way joint 12*a*, one of the inflow ports of the sixth three-way joint 12*f* is connected. A refrigerant passage extending from the other outflow port of the first three-way joint 12*a* to one of the inflow ports of the sixth three-way joint 12*f* is a bypass passage 21*a*. In the bypass passage 21*a*, a bypass flow-rate adjustment valve 14*d* is disposed.

The bypass flow-rate adjustment valve 14*d* is a depressurization unit on the bypass side, which depressurizes a discharged refrigerant which has flowed out from the other outflow port of the first three-way joint 12*a* (that is, the other discharged refrigerant branched by the first three-way joint 12*a*) in a hot gas heating mode or the like which will be described later. The bypass flow-rate adjustment valve 14*d* is a bypass-side flow rate adjustment unit adjusting the flow rate (mass flow rate) of the refrigerant passing through the bypass passage 21*a*.

The bypass flow-rate adjustment valve 14*d* is an electric variable throttle mechanism having a valve body which changes the throttle opening and an electric actuator (concretely, a stepping motor) which makes the valve body displaced. The operation of the bypass flow-rate adjustment valve 14*d* is controlled by a control pulse output from the control device 60.

The bypass flow-rate adjustment valve 14*d* has a full throttle function functioning as a simple refrigerant passage by fully opening the valve almost without displaying refrigerant depressurizing performance and flow-rate adjusting performance. The bypass flow-rate adjustment valve 14*d* has a full closing function of closing the refrigerant passage by totally closing the valve.

Further, as will be described later, the heat pump cycle 10 has a heating expansion valve 14*a*, a cooling expansion valve 14*b*, a chiller expansion valve 14*c*, and a defrosting flow-rate adjustment valve 14*e*. The basic configuration of each of the heating expansion valve 14*a*, the cooling expansion valve 14*b*, the chiller expansion valve 14*c*, and the defrosting flow-rate adjustment valve 14*e* is similar to that of the bypass flow-rate adjustment valve 14*d*.

By displaying the above-described totally closing function, the heating expansion valve 14*a*, the cooling expansion valve 14*b*, the chiller expansion valve 14*c*, the bypass flow-rate adjustment valve 14*d*, and the defrosting flow-rate adjustment valve 14*e* can switch the refrigerant circuit. Therefore, the heating expansion valve 14*a*, the cooling expansion valve 14*b*, the chiller expansion valve 14*c*, the bypass flow-rate adjustment valve 14*d*, and the defrosting flow-rate adjustment valve 14*e* also have the function as a refrigerant circuit switching unit.

Obviously, the heating expansion valve 14*a*, the cooling expansion valve 14*b*, the chiller expansion valve 14*c*, the bypass flow-rate adjustment valve 14*d*, and the defrosting flow-rate adjustment valve 14*e* may be formed by combining a variable throttle mechanism which does not have the full closing function and an on-off valve which opens/closes a throttle passage. In this case, each of the open/close valves serves as a refrigerant circuit switching unit.

The inside condenser 13 is mounted in an air-conditioning case 51 of the inside air-conditioning unit 50 which will be described later. The inside condenser 13 is a heat exchanging unit for heating, which performs heat exchange between a discharged refrigerant which has flowed out from one of outflow ports of the first three-way joint 12*a* (that is, one of discharged refrigerants branched by the first three-way joint 12*a*) and blown air passed through an inside evaporator 18 which will be described later. In the inside evaporator 18, the heat of the discharged refrigerant is dissipated to the blown air, thereby heating the blown air.

Therefore, the inside condenser 13 is a heating unit heating blown air as a heating target by using, as a heat source, one of the discharged refrigerants branched by the first three-way joint 12*a*.

To the outlet of the inside condenser 13, an inflow port side of the second three-way joint 12*b* is connected. To one of the outflow ports of the second three-way joint 12*b*, the inflow port of the heating expansion valve 14*a* is connected. To the other outflow ports of the second three-way joint 12*b*, one inflow port of the four-way joint 12*x* is connected. The refrigerant passage extending from the other outflow port of the second three-way joint 12*b* to one of inflow ports of the four-way joint 12*x* is a dehumidification passage 21*b*.

In the dehumidification passage 21*b*, a dehumidifying on-off valve 22*a* is disposed. The dehumidifying on-off valve 22*a* is an on-off valve which opens/closes the dehumidification passage 21*b*. The dehumidifying on-off valve 22*a* is an electromagnetic valve whose opening/closing operation is controlled by control voltage output from the control device 60. The dehumidifying on-off valve 22*a* can switch the refrigerant circuit by opening/closing the dehumidification passage 21*b*. Therefore, the dehumidifying on-off valve 22*a* is a refrigerant circuit switching unit.

The four-way joint 12*x* is a joint unit having four inflow/outflow ports which communicate with one another. As the four-way joint 12*x*, a joint unit formed in a manner similar to the above-mentioned three-way joint can be employed. As the four-way joint 12*x*, a joint formed by combining two three-way joints may be also employed.

The heating expansion valve 14*a* is a depressurization unit on the side of an outside heat exchanger, depressurizing the refrigerant flowing in an outside heat exchanger 15 in a heating mode or the like which will be described later. Further, the heating expansion valve 14*a* is also a flow rate adjusting unit on the side of the outside heat exchanger adjusting the flow rate (mass flow rate) of the refrigerant flowing in the outside heat exchanger 15.

To the outlet of the heating expansion valve 14*a* the refrigerant inlet side of the outside heat exchanger 15 is connected. The outside heat exchanger 15 is an outside heat exchanging unit performing heat exchange between the refrigerant which has flowed out from the heating expansion valve 14*a* and outside air sent by a not-illustrated outside-air fan. The outside heat exchanger 15 is mounted in a front part of a drive device chamber Consequently, when the vehicle travels, travel air flowing in the drive device chamber via a grill can be applied to the outside heat exchanger 15.

To the refrigerant outlet of the outside heat exchanger 15, the inflow port of the third three-way joint 12*c* is connected. To one of the outflow ports of the third three-way joint 12*c*, another inflow port of the four-way joint 12*x* is connected via a first check valve 16*a*. To the other outflow port of the third three-way joint 12*c*, one of the inflow ports of a fourth three-way joint 12*d* is connected. The refrigerant passage extending from the other outflow port of the third three-way joint 12*c* to one of the inflow ports of the fourth three-way joint 12*d* is a heating passage 21*c*.

In the heating passage 21*c*, the defrosting flow-rate adjustment valve 14*e* is disposed. The defrosting flow-rate adjustment valve 14*e* is a depressurization unit on the heating passage side of depressurizing the refrigerant which has flowed out from the outside heat exchanger 15 in a defrosting mode which will be described later. The defrosting flow-rate adjustment valve 14*e* is a flow-rate adjusting unit on the heating passage side of adjusting the flow rate (mass flow rate) of the refrigerant passing through the heating passage 21*c*.

The first check valve 16*a* allows the refrigerant to flow from the third three-way joint 12*c* side to the four-way joint 12*x* side, and inhibits the refrigerant from flowing from the four-way joint 12*x* side to the third three-way joint 12*c* side.

To one of the outflow ports of the four-way joint 12*x*, the refrigerant inlet side of the inside evaporator 18 is connected via the cooling expansion valve 14*b*. The cooling expansion valve 14*b* is a depressurizing unit on the side of the inside evaporator for the refrigerant which has flowed out from one of the outflow ports of the four-way joint 12*x* in a cooling mode which will be described later. Further, the cooling expansion valve 14*b* is a flow-rate adjusting unit on the side of the inside evaporator for adjusting the flow rate (mass flow rate) of the refrigerant flowing in the inside evaporator 18.

The inside evaporator 18 is mounted in the air-conditioning case 51 of the inside air-conditioning unit 50. The inside evaporator 18 is a cooling evaporating unit performing heat exchange between a low-pressure refrigerant subjected to depressurization by the cooling expansion valve 14*b* and blown air sent from an inside blower 52 into the vehicle compartment. The inside evaporator 18 cools the blown air by making the low-pressure refrigerant evaporate to display heat absorbing action.

To the refrigerant outlet of the inside evaporator 18, one of the inflow ports of the fifth three-way joint 12*e* is connected via an evaporation pressure regulation valve 19 and a second check valve 16*b*.

The evaporation pressure regulation valve 19 is a variable throttle mechanism which maintains the refrigerant evaporation temperature in the inside evaporator 18 to be equal to or higher than a temperature at which frost formation in the inside evaporator 18 can be suppressed (in the embodiment, one degree). The evaporation pressure regulation valve 19 is configured by a mechanical machine which increases the valve opening with rise of the pressure of the refrigerant on the refrigerant outlet side of the inside evaporator 18.

The second check valve 16*b* allows the refrigerant to flow from the outlet side of the evaporation pressure regulation valve 19 to the fifth three-way joint 12*e* side, and inhibits the refrigerant from flowing from the fifth three-way joint 12*e* side to the evaporation pressure regulation valve 19 side.

To another one of the outflow ports of the four-way joint 12*x*, the other inflow port of the sixth three-way joint 12*f* is connected via the chiller expansion valve 14*c*. To the outflow port of the sixth three-way joint 12*f*, the inflow port of the refrigerant passage of a chiller 20 is connected.

The chiller expansion valve 14*c* is a chiller-side depressurization unit depressurizing the refrigerant flowing in the chiller 20 in a hot gas heating mode which will be described later. Further, the chiller expansion valve 14*c* is a chiller-side flow rate adjusting unit adjusting the flow rate (mass flow rate) of the refrigerant flowing in the chiller 20.

The chiller 20 is a cooling evaporation unit evaporating low-pressure refrigerant by heat exchange between the low-pressure refrigerant subjected to the depressurization in the chiller expansion valve 14*c* and the low-temperature heating medium circulating in the low-temperature heating medium circuit 30. In the chiller 20, by evaporating the low-pressure refrigerant to display the heat absorption action, the low-temperature heating medium is cooled.

To the outlet of the refrigerant passage of the chiller 20, the other inflow port of the fourth three-way joint 12*d* is connected. To the outflow port of the fourth three-way joint 12*d*, the other inflow port of the fifth three-way joint 12*e* is connected.

To the outflow port of the fifth three-way joint 12*e*, the inflow port of the accumulator 23 is connected. The accumulator 23 is a low-pressure-side vapor-liquid separator separating the vapor of the refrigerant flowing to the inside and storing surplus liquid phase refrigerant in the cycle. The outlet of the accumulator 23 is connected to the suction port side of the compressor 11.

Next, the low-temperature heating medium circuit 30 will be described. The low-temperature heating medium circuit 30 is a heating medium circuit making the low-temperature heating medium circulate. The low-temperature heating medium circuit 30 employs ethylene glycol aqueous solution as the low-temperature heating medium. To the low-temperature heating medium circuit 30, as illustrated in FIG. 1, a low-temperature pump 31, a cooling water passage 70*a* of the battery 70, the heating medium passage of the chiller 20, and the like are connected.

The low-temperature pump 31 is a pressure feed unit pressure-feeding the low-temperature heating medium which has flowed out from the cooling water passage 70*a* of the battery 70 to the inlet side of the heating medium passage of the chiller 20. The low-temperature pump 31 is an electric water pump whose rotational speed (that is, pressure feed capability) is controlled by control voltage output from the control device 60. To the outlet side of the heating medium passage of the chiller 20, the inlet side of the cooling water passage 70*a* of the battery 70 is connected.

The cooling water passage 70*a* of the battery 70 is formed in a battery dedicated case for housing a plurality of battery cells staked. The configuration of the cooling water passage 70*a* is that a plurality of passages are connected in parallel in the battery dedicated case. With the configuration, all of the battery cells can be cooled uniformly in the cooling water passage 70*a*. To the outlet of the cooling water passage 70*a*, the suction port side of the low-temperature pump 31 is connected.

Next, the inside air-conditioning unit 50 will be described. The inside air-conditioning unit 50 is a unit obtained by integrating a plurality of element devices to blow the blown air adjusted to a proper temperature for air conditioning in the compartment to a proper position in the compartment. The inside air-conditioning unit 50 is mounted on the inside of the instrument panel at the forefront in the compartment.

Figure 2:
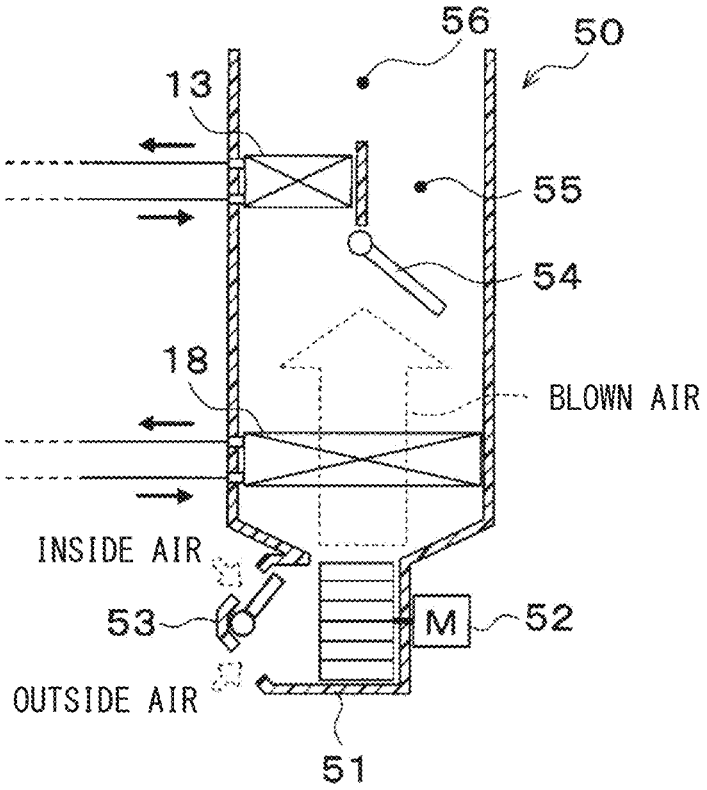
FIG. 2 is a schematic configuration diagram of an inside air-conditioning unit of a first embodiment.

As illustrated in FIG. 2, the inside air-conditioning unit 50 is formed by housing, in the air-conditioning case 51 forming the air passage of the blown air, the inside blower 52, the inside evaporator 18, the inside condenser 13, and the like. The air-conditioning case 51 is formed of a resin having elasticity to a certain extent and excellent strength (for example, polypropylene).

An inside-outside air switching device 53 is mounted on the most upstream side of the blast air flowing of the air-conditioning case 51. The inside-outside air switching device 53 introduces inside air (that is, the air in the compartment) and outside air (that is, the air outside of the compartment) into the air-conditioning case 51 while switching them. The operation of the inside-outside air switching device 53 is controlled by a control signal output from the control device 60.

The inside blower 52 is provided on the downstream side of the blown air flow of the inside-outside air switching device 53. The inside blower 52 blows air which is sucked via the inside-outside air switching device 53 toward the inside of the compartment. The rotational speed (that is, blowing capability) of the inside blower 52 is controlled by control voltage output from the control device 60.

The inside evaporator 18 and the inside condenser 13 are provided on the downstream side of the blown air flow of the inside blower 52. The inside evaporator 18 is mounted on the upstream side of the blown air than the inside condenser 13. In the air-conditioning case 51, a cooling air bypass passage 55 for flowing the blown air which passed through the inside condenser 18 so as to bypass the inside condenser 13 is formed.

An air mix door 54 is mounted on the downstream side of the blown air flow of the inside evaporator 18 in the air-conditioning case 51 and on the upstream side of the blown air flow of the cooling air bypass passage 55.

The air mix door 54 adjusts the air volume ratio between the air volume of the blown air to be passed through the inside condenser 13 and the air volume of the blown air to be passed through the cooling air bypass passage 55 in the blown air passed through the inside evaporator 18. The operation of the actuator for driving of the air mix door 54 is controlled by a control signal output from the control device 60.

A mixing space 56 is provided on the downstream side of the blown air flow of the inside condenser 13 and the cooling air bypass passage 55. The mixing space 56 is a space where the blown air heated by the inside condenser 13 and the unheated blown air passed through the cooling air bypass passage 55 are mixed.

Therefore, in the inside air-conditioning unit 50, the temperature of the blown air subjected to mixing in the mixing space 56 and blown to the inside of the compartment (that is, air-conditioned air) can be adjusted by adjusting the opening of the air mix door 54.

In the most downstream part of the blown air flow of the air-conditioning case 51, a plurality of not-illustrated openings for blowing the air-conditioned air towards various places in the compartment are formed. The plurality of openings are provided with a not-illustrated blow mode door for opening/closing each of the openings. The operation of the actuator for driving of the blow mode door is controlled by a control signal output from the control device 60.

Therefore, in the inside air-conditioning unit 50, by switching the openings which are open/closed by the blow mode door, the air-conditioned air which is adjusted to a proper temperature can be blown to proper places in the compartment.

Next, the electric control unit of the embodiment will be described. The control device 60 has a known microcomputer including a CPU, a ROM, and a RAM and its peripheral circuits. The control device 60 performs various operations and processes on the basis of control programs stored in the ROM. The control device 60 controls the operations of various devices 11, 14*a* to 14*e*, 22*a*, 31, 52, 53, and the like connected on the output side on the basis of results of the operations and processes.

Figure 3:
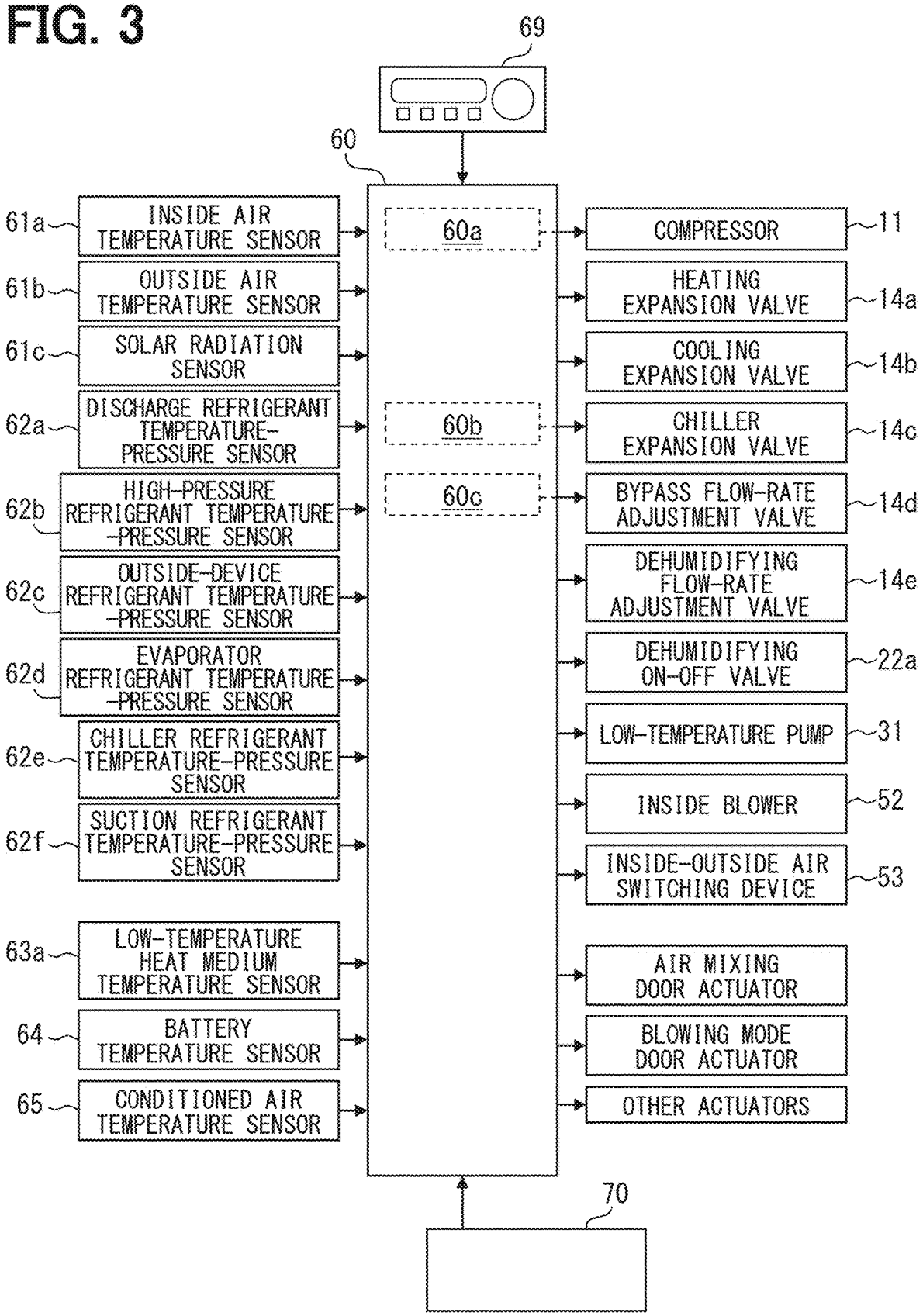
FIG. 3 is a block diagram illustrating an electric control unit of the air conditioner for a vehicle of the first embodiment.

As illustrated in the block diagram of FIG. 3, on the input side of the control device 60, a sensor group for control is connected, which includes an inside air temperature sensor 61*a*, an outside air temperature sensor 61*b*, a solar radiation sensor 61*c*, a discharge refrigerant temperature-pressure sensor 62*a*, a high-pressure refrigerant temperature-pressure sensor 62*b*, an outside-device refrigerant temperature-pressure sensor 62*c*, an evaporator refrigerant temperature-pressure sensor 62*d*, a chiller refrigerant temperature-pressure sensor 62*e*, a suction refrigerant temperature-pressure sensor 62*f*, a low-temperature heat medium temperature sensor 63*a*, a battery temperature sensor 64, and a conditioned air temperature sensor 65.

The inside air temperature sensor 61*a* is an inside air temperature detection unit detecting in-compartment temperature (inside temperature) Tr. The outside air temperature sensor 61*ab* is an outside air temperature detection unit detecting out-compartment temperature (outside temperature) Tam. The solar radiation sensor 61*c* is a solar radiation amount detection unit detecting a solar radiation amount As of solar radiation to the inside of the compartment.

The discharge refrigerant temperature-pressure sensor 62*a* is a discharge refrigerant temperature and pressure detection unit detecting a discharged refrigerant temperature Td and a discharged refrigerant pressure Pd of the refrigerant discharged from the compressor 11.

The high-pressure refrigerant temperature-pressure sensor 62*b* is a high-pressure refrigerant temperature and pressure detection unit detecting a high-pressure refrigerant temperature T1 and a high-pressure refrigerant pressure P1 of the refrigerant which has flowed out from the inside condenser 13.

The outside-device refrigerant temperature-pressure sensor 62*c* is an outside-device refrigerant temperature and pressure detection unit detecting an outside-device refrigerant temperature T2 and an outside-device refrigerant pressure P2 of the refrigerant which has flowed out from the outside heat exchanger 15.

The evaporator refrigerant temperature-pressure sensor 62*d* is an evaporator refrigerant temperature and pressure detection unit detecting an evaporator refrigerant temperature Te and an evaporator refrigerant pressure Pe of the refrigerant which has flowed out from the inside evaporator 18.

The chiller refrigerant temperature-pressure sensor 62*e* is a chiller refrigerant temperature and pressure detection unit detecting a chiller refrigerant temperature Tc and a chiller refrigerant pressure Pc of the refrigerant which has flowed out from the refrigerant passage of the chiller 20.

The suction refrigerant temperature-pressure sensor 62*f* is a suction refrigerant temperature and pressure detection unit detecting a suctioned refrigerant temperature Ts and a suctioned refrigerant pressure Ps of the refrigerant sucked into the compressor 11.

Although the detection unit configured by integrating a pressure detection unit and a temperature detection unit is employed as a refrigerant temperature-pressure sensor in the embodiment, obviously, a pressure detection unit and a temperature detection unit configured as separate units may be also employed.

The low-temperature heat medium temperature sensor 63*a* is a low-temperature heat medium temperature detection unit detecting a low-temperature heat medium temperature TWL as the temperature of the low-temperature heating medium flowing in the cooling water passage 70*a* of the battery 70.

The battery temperature sensor 64 is a battery temperature detection unit detecting a battery temperature TB as the temperature of the battery 70. The battery temperature sensor 64 has a plurality of temperature sensors to detect temperatures at a plurality of places in the battery 70. Consequently, the control device 60 can detect temperature differences of the battery cells constructing the battery 70 and a temperature distribution. Further, as the battery temperature TB, an average value of detection values of the plurality of temperature sensors is employed.

The conditioned air temperature sensor 65 is a conditioned air temperature detection unit detecting a blown-air temperature TAV of the air blown from the mixing space 56 into the compartment.

Further, on the input side of the control device 60, as illustrated in FIG. 3, an operation panel 69 mounted near the instrument panel in the front part of the compartment is connected. Operation signals from various operation switches provided for the operation panel 69 are input to the control device 60.

The various operation switches provided for the operation panel 69 include, concretely, an auto switch, an air-conditioner switch, an air volume setting switch, and a temperature setting switch.

The auto switch is an operation switch setting or cancelling automatic control operation of the air conditioner 1 for a vehicle. The air-conditioner switch is an operation switch requesting to cool the blown air by the inside evaporator 18. The air volume setting switch is an operation switch manually setting the air volume of the inside blower 52. The temperature setting switch is an operation switch setting a set temperature Tset in the compartment.

The control device 60 of the embodiment is configured by integrating control units controlling various control target devices connected to the output side. Therefore, the component (hardware and software) controlling the operation of each of the control target devices is the control unit controlling the operation of each of the control target devices.

For example, the component controlling the refrigerant discharge capability (concretely, the rotational speed) of the compressor 11 in the control device 60 is a discharge capability control unit 60*a*. The component controlling the operation of the chiller expansion valve 14*c* is a heating unit control unit 60*b*. The component controlling the operation of the bypass flow-rate adjustment valve 14*d* is a bypass control unit 60*c*.

Subsequently, the operation of the air conditioner 1 for a vehicle of the embodiment with the above-described configuration will be described. In the air conditioner 1 for a vehicle of the embodiment, various operation modes are switched to perform air conditioning in the compartment and adjustment of the temperature of the battery 70. The operation mode is switched by executing a control program which is preliminarily stored in the control device 60.

The control program is executed not only when a so-called IG switch is on and the vehicle system is activated but also in the case such that the battery 70 is charged from an external power source. A main routine of a control program will be described with reference to FIG. 4. Various control steps in the flowchart of FIG. 4 and the like are various function realizing units of the control device 60.

Figure 4:
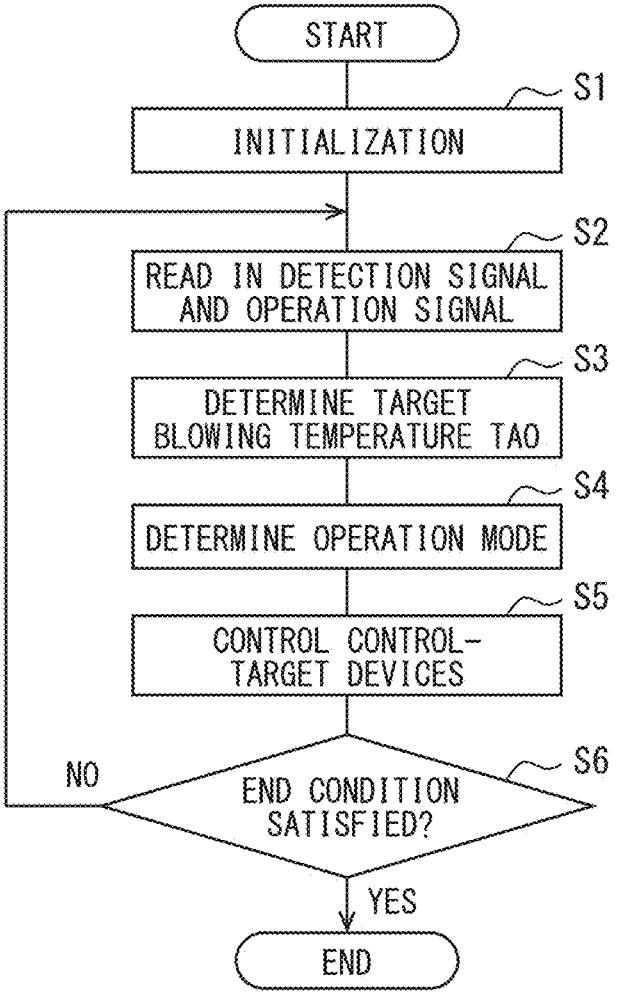
FIG. 4 is a flowchart of a main routine of a control program of the first embodiment.

In step S1 in FIG. 4, initialization of a flag, a timer, and the like and initialization such as initial positioning of an electric actuator are performed. In step S2, detection signals of the sensor group for control and an operation signal of the operation panel 69 are read. In step S3, the target blowing temperature TAO is determined. The target blowing temperature TAO is a target temperature of the blown air which is blown into the compartment. Therefore, step S3 corresponds to a target temperature determining unit.

In step S3, concretely, the target blowing temperature TAO is determined by using the following formula F1.

$$TAO = Kset \times Tset - Kr \times Tr - Kam \times Tam - Ks \times As + C \quad \text{(F1)}$$

Tset is a target temperature in the compartment, which is set by a temperature setting switch. Tr is an inside temperature detected by the inside air temperature sensor 61*a*. Tam is an outside temperature detected by the outside air temperature sensor 61*b*. As is a solar radiation amount detected by the solar radiation sensor 61*c*. Kset, Kr, Kam, and Ks are control gains, and C denotes a constant for correction.

In step S4, an operation mode is selected by using the detection signal and the operation signal read in step S2 and the target blowing temperature TAO determined in step S3. In step S5, the operations of various control target devices are controlled so that the operation mode selected in step S4 is executed.

In step S6, whether or not an end condition of the air conditioner 1 for a vehicle, which is preliminarily determined is satisfied is determined. When it is determined in step S6 that the end condition is not satisfied, the program returns to step S2. When it is determined in step S6 that the end condition is satisfied, the program is finished.

The end condition in the embodiment is satisfied when the IG switch is set to an off state (OFF) in a state where the battery 70 is not charged from the external power source. Alternatively, the end condition is satisfied when charging of the battery 70 from the external power source is finished in a state where the IG switch is in the off state (OFF). Hereinafter, the detailed operation in each of the operation modes selected in step S4 will be described.

(a) Cooling Mode

A cooling mode is an operation mode of cooling the inside of the compartment by blowing cooled air into the compartment. In the control program of the embodiment, mainly, when the outside temperature Tam is a relatively high temperature like in summer (in the embodiment, more than 25° C.), the cooling mode is selected.

The cooling mode includes a cooling-only mode of cooling the inside of the compartment without cooling the battery 70 and a chilling and cooling mode of chilling the battery 70 and also cooling the inside of the compartment. In the control program of the embodiment, when the battery temperature TB becomes equal to or higher than a reference upper-limit temperature KTBH which is determined in advance, the operation mode of chilling the battery 70 as an in-vehicle device is executed.

(a-1) Cooling-Only Mode

In the heat pump cycle 10 in the cooling-only mode, the control device 60 sets the heating expansion valve 14*a* in a full open state, sets the cooling expansion valve 14*b* in a regulated state displaying the refrigerant depressurizing action, sets the chiller expansion valve 14*c* in a fully closed state, sets the bypass flow-rate adjustment valve 14*d* in a fully closed state, and sets the defrosting flow-rate adjustment valve 14*e* in a fully closed state. The control device 60 closes the dehumidifying on-off valve 22*a*.

Consequently, the heat pump cycle 10 in the cooling-only mode is switched to a refrigerant circuit in which the refrigerant discharged from the compressor 11 circulates, in order, the inside condenser 13, the heating expansion valve 14*a* which is in the fully open state, the outside heat exchanger 15, the cooling expansion valve 14*b* in the regulated state, the inside evaporator 18, the evaporation pressure regulation valve 19, the accumulator 23, and the suction port of the compressor 11.

In the inside air-conditioning unit 50 in the cooling-only mode, the control device 60 adjusts the opening of the air mix door 54 so that the blown air temperature TAV detected by the conditioned air temperature sensor 65 comes close to the target blowing temperature TAO. The control device 60 also controls the inside-outside air switching device 53 and the operation of the door on the basis of the target blowing temperature TAO. The control device 60 also properly controls the operations of the other control target devices.

Therefore, in the heat pump cycle 10 in the cooling-only mode, a refrigeration cycle of a vapor compression type is configured so that the inside condenser 13 and the outside heat exchanger 15 function as a condenser which makes the refrigerant radiate heat and condenses the refrigerant, and the inside evaporator 18 functions as an evaporator evaporating the refrigerant.

In the inside air-conditioning unit 50 in the cooling-only mode, the air blown from the inside blower 52 is cooled in the inside evaporator 18. The blown air cooled by the inside evaporator 18 is heated again by the inside condenser 13 so that the temperature comes close to the target blowing temperature TAO in accordance with the opening of the air mix door 54. Then, by blowing the temperature-adjusted air into the compartment, cooling of the inside of the compartment is realized.

(a-2) Chilling and Cooling Mode

In the heat pump cycle 10 in the chilling and cooling mode, in contrast to the cooling-only mode, the control device 60 sets the chiller expansion valve 14*c* in a regulated state.

Consequently, in the heat pump cycle 10 in the chilling and cooling mode, the refrigerant discharged from the compressor 11 circulates in a manner similar to the cooling-only mode. Simultaneously, the refrigerant circuit is switched to a refrigerant circuit in which the refrigerant discharged from the compressor 11 circulates, in order, the inside condenser 13, the heating expansion valve 14*a* which is in the fully open state, the outside heat exchanger 15, the chiller expansion valve 14*c* in the regulated state, the chiller 20, the accumulator 23, and the suction port of the compressor 11. That is, the refrigerant circuit is switched to a refrigerant circuit in which the inside evaporator 18 and the chiller 20 are connected in parallel to the flow of the refrigerant.

In the low-temperature heating medium circuit 30 in the chilling and cooling mode, the control device 60 operates the low-temperature pump 31 so that the predetermined reference pressure-feed capability is displayed. Consequently, in the low-temperature heating medium circuit 30, the low-temperature heating medium which is pressure-fed from the low-temperature pump 31 circulates, in order, the heating medium passage in the chiller 20, the cooling water passage 70*a* in the battery 70, and the suction port of the low-temperature pump 31.

In the inside air-conditioning unit 50 in the chilling and cooling mode, as in the cooling-only mode, the control device 60 controls the blowing capability of the inside blower 52, the opening of the air mix door 54, the inside-outside air switching device 53, and the operation of the blowing-mode door. The control device 60 also properly controls the operations of the other control target devices.

Therefore, in the heat pump cycle 10 in the chilling and cooling mode, the refrigeration cycle of the vapor compression type is configured in which the inside condenser 13 and the outside heat exchanger 15 function as a condenser, and the inside evaporator 18 and the chiller 20 function as an evaporator.

In the low-temperature heating medium circuit 30 in the chilling and cooling mode, the low-temperature heating medium which is pressure-fed from the low-temperature pump 31 flows in the chiller 20 and is chilled. The low-temperature heating medium chilled by the chiller 20 passes through the cooling water passage 70*a* in the battery 70, thereby cooling the battery 70.

In the inside air-conditioning unit 50 in the chilling and cooling mode, as in the cooling-only mode, by blowing the temperature-adjusted air into the compartment, cooling of the inside of the compartment is realized.

(b) Serial Dehumidifying-Heating Mode

A serial dehumidifying-heating mode is an operation mode of dehumidifying and heating the inside of the compartment by re-heating the blown air which was cooled and dehumidified and blowing the resultant air into the compartment. In the control program of the embodiment, when the outside temperature Tam is a temperature in a predetermined intermediate/high temperature range (in the embodiment, 10° C. or higher and less than 25° C.), the serial dehumidifying-heating mode is selected.

The serial dehumidifying-heating mode includes a serial-dehumidifying-heating-only mode of dehumidifying-heating the inside of the compartment without cooling the battery 70, and a chilling and serial-dehumidifying-heating mode of dehumidifying-heating the battery 70 and also cooling the inside of the compartment.

(b-1) Serial-Dehumidifying-Heating-Only Mode

In the heat pump cycle 10 in the serial-dehumidifying-heating-only mode, the control device 60 sets the heating expansion valve 14*a* in a regulated state, sets the cooling expansion valve 14*b* in a regulated state, sets the chiller expansion valve 14*c* in a fully closed state, sets the bypass flow-rate adjustment valve 14*d* in a fully closed state, and sets the defrosting flow-rate adjustment valve 14*e* in a fully closed state. The control device 60 closes the dehumidifying on-off valve 22*a*.

Consequently, the heat pump cycle 10 in the serial-dehumidifying-heating-only mode is switched to a refrigerant circuit in which the refrigerant discharged from the compressor 11 circulates, in order, the inside condenser 13, the heating expansion valve 14*a* which is in the regulated state, the outside heat exchanger 15, the cooling expansion valve 14*b* in the regulated state, the inside evaporator 18, the evaporation pressure regulation valve 19, the accumulator 23, and the suction port of the compressor 11.

In the inside air-conditioning unit 50 in the serial-dehumidifying-heating-only mode, as in the cooling-only mode, the control device 60 controls the blowing capability of the inside blower 52, the opening of the air mix door 54, the inside-outside air switching device 53, and the operation of the blowing-mode door. The control device 60 also properly controls the operations of the other control target devices.

Therefore, in the heat pump cycle 10 in the serial-dehumidifying-heating-only mode, the refrigeration cycle of the vapor compression type is configured in which the inside condenser 13 is made function as a condenser, and the inside evaporator 18 is made function as an evaporator.

Further, in the serial-dehumidifying-heating-only mode, when saturation temperature of the refrigerant in the outside heat exchanger 15 is higher than the outside temperature Tam, the outside heat exchanger 15 is made function as a condenser. In the case where the saturation temperature of the refrigerant in the outside heat exchanger 15 is lower than the outside temperature Tam, the outside heat exchanger 15 is made function as an evaporator.

In the inside air-conditioning unit 50 in the serial-dehumidifying-heating-only mode, the air blown from the inside blower 52 is cooled and dehumidified by the inside evaporator 18. The blown air cooled and dehumidified by the inside evaporator 18 is heated again by the inside condenser 13 so that the temperature comes close to the target blowing temperature TAO in accordance with the opening of the air mix door 54. When the blown air whose temperature is adjusted is blown into the compartment, dehumidification and heating in the compartment is realized.

(b-2) Chilling and Serial-Dehumidifying-Heating Mode

In the heat pump cycle 10 in the chilling and the chilling and serial-dehumidifying-heating mode, in contrast to the serial-dehumidifying-heating-only mode, the control device 60 sets the chiller expansion valve 14*c* in a regulated state.

Therefore, in the heat pump cycle 10 in the chilling and serial-dehumidifying-heating mode, the refrigerant discharged from the compressor 11 circulates in a manner similar to the serial-dehumidifying-heating-only mode. Simultaneously, the refrigerant circuit is switched to a refrigerant circuit in which the refrigerant discharged from the compressor 11 circulates, in order, the inside condenser 13, the heating expansion valve 14*a* in the regulated state, the outside heat exchanger 15, the chiller expansion valve 14*c* in the regulated state, the chiller 20, the accumulator 23, and the suction port of the compressor 11. That is, the refrigerant circuit is switched to a refrigerant circuit in which the inside evaporator 18 and the chiller 20 are connected in parallel to the flow of the refrigerant.

In the low-temperature heating medium circuit 30 in the chilling and serial-dehumidifying-heating mode, the control device 60 controls the operation of the low-temperature pump 31 in a manner similar to the chilling and cooling mode. Consequently, in the low-temperature heating medium circuit 30 in the chilling and serial-dehumidifying-heating mode, the low-temperature heating medium circulates as in the chilling and cooling mode.

In the inside air-conditioning unit 50 in the chilling and serial-dehumidifying-heating mode, as in the cooling-only mode, the control device 60 controls the blowing capability of the inside blower 52, the opening of the air mix door 54, the inside-outside air switching device 53, and the operation of the blowing-mode door. The control device 60 also properly controls the operations of the other control target devices.

Therefore, in the heat pump cycle 10 in the chilling and serial-dehumidifying-heating mode, the refrigeration cycle of the vapor compression type is configured in which the inside condenser 13 is made function as a condenser, and the inside evaporator 18 and the chiller 20 are made function as an evaporator.

Further, in the chilling and serial-dehumidifying-heating mode, as in the serial-dehumidifying-heating-only mode, when the saturation temperature of the refrigerant in the outside heat exchanger 15 is higher than the outside temperature Tam, the outside heat exchanger 15 is made function as a condenser. In the case where the saturation temperature of the refrigerant in the outside heat exchanger 15 is lower than the outside temperature Tam, the outside heat exchanger 15 is made function as an evaporator.

In the low-temperature heating medium circuit 30 in the chilling and serial-dehumidifying-heating mode, as in the chilling and cooling mode, the low-temperature heating medium chilled by the chiller 20 passes through the cooling water passage 70*a* in the battery 70, thereby cooling the battery 70.

In the inside air-conditioning unit 50 in the chilling and serial-dehumidifying-heating mode, as in the serial-dehumidifying-heating-only mode, the blown air whose temperature is adjusted is blown into the compartment, thereby realizing dehumidification and heating in the compartment.

(c) Parallel Dehumidifying-Heating Mode

A parallel dehumidifying-heating mode is an operation mode of performing dehumidification and heating in the compartment by re-heating cooled and dehumidified blown air with heating capability higher than that in the serial dehumidifying-heating mode and blowing the re-heated air into the compartment. In the control program of the embodiment, when the outside temperature Tam is a temperature in a predetermined low/intermediate temperature range (in the embodiment, 0° C. or higher and less than 10° C.), the parallel dehumidifying-heating mode is selected.

The parallel dehumidifying-heating mode includes a parallel-dehumidifying-heating-only mode of dehumidifying-heating the inside of the compartment without cooling the battery 70, and a chilling and parallel-dehumidifying-heating mode of dehumidifying-heating the battery 70 and also cooling the inside of the compartment.

(c-1) Parallel-Dehumidifying-Heating-Only Mode

In the heat pump cycle 10 in the parallel-dehumidifying-heating-only mode, the control device 60 sets the heating expansion valve 14*a* in a regulated state, sets the cooling expansion valve 14*b* in a regulated state, sets the chiller expansion valve 14*c* in a fully closed state, sets the bypass flow-rate adjustment valve 14*d* in a fully closed state, and sets the defrosting flow-rate adjustment valve 14*e* in a fully open state. The control device 60 also opens the dehumidifying on-off valve 22*a*.

Consequently, in the heat pump cycle 10 in the parallel-dehumidifying-heating-only mode, the refrigerant discharged from the compressor 11 circulates, in order, the inside condenser 13, the heating expansion valve 14*a* in the regulated state, the outside heat exchanger 15, the heating passage 21*c*, the accumulator 23, and the suction port of the compressor 11. Simultaneously, the refrigerant circuit is switched to a refrigerant circuit in which the refrigerant discharged from the compressor 11 circulates, in order, the inside condenser 13, the dehumidification passage 21*b*, the cooling expansion valve 14*b* in the regulated state, the inside evaporator 18, the evaporation pressure regulation valve 19, the accumulator 23, and the suction port of the compressor 11. That is, the refrigerant circuit is switched to a refrigerant circuit in which outside heat exchanger 15 and the inside evaporator 18 are connected in parallel to the flow of the refrigerant.

In the inside air-conditioning unit 50 in the parallel-dehumidifying-heating-only mode, as in the cooling-only mode, the control device 60 controls the blowing capability of the inside blower 52, the opening of the air mix door 54, the inside-outside air switching device 53, and the operation of the blowing-mode door. The control device 60 also properly controls the operations of the other control target devices.

Therefore, in the heat pump cycle 10 in the parallel-dehumidifying-heating-only mode, the refrigeration cycle of the vapor compression type in which the inside condenser 13 is made function as a condenser and the outside heat exchanger 15 and the inside evaporator 18 are made function as an evaporator is configured.

In the inside air-conditioning unit 50 in the parallel-dehumidifying-heating-only mode, the air blown from the inside blower 52 is cooled and dehumidified by the inside evaporator 18. The blown air cooled and dehumidified by the inside evaporator 18 is heated again by the inside condenser 13 so that the temperature comes close to the target blowing temperature TAO in accordance with the opening of the air mix door 54. When the blown air whose temperature is adjusted is blown into the compartment, dehumidification and heating in the compartment is realized.

Further, in the heat pump cycle 10 in the parallel-dehumidifying-heating-only mode, the throttle opening of the heating expansion valve 14*a* can be decreased more than that of the cooling expansion valve 14*b*. With the configuration, the refrigerant evaporation temperature in the outside heat exchanger 15 can be decreased to a temperature lower than the refrigerant evaporation temperature in the inside evaporator 18.

Therefore, in the parallel-dehumidifying-heating-only mode, the heat absorption amount from the outside air of the refrigerant in the outside heat exchanger 15 is increased more than that in the serial-dehumidifying-heating-only mode, and the heat radiation amount to the blown air from the refrigerant in the inside condenser 13 can be increased. As a result, in the parallel-dehumidifying-heating-only mode, the heating capability of the blown air in the inside condenser 13 can be improved as compared with that in the serial-dehumidifying-heating-only mode.

(c-2) Chilling and Parallel-Dehumidifying-Heating Mode

In the heat pump cycle 10 in the chilling and parallel-dehumidifying-heating mode, in contrast to the parallel-dehumidifying-heating-only mode, the control device 60 sets the chiller expansion valve 14*c* in a regulated state.

Therefore, in the heat pump cycle 10 in the chilling and parallel-dehumidifying-heating mode, the refrigerant discharged from the compressor 11 circulates in a manner similar to the parallel-dehumidifying-heating-only mode. Simultaneously, the refrigerant circuit is switched to a refrigerant circuit in which the refrigerant discharged from the compressor 11 circulates, in order, the inside condenser 13, the dehumidification passage 21*b*, the chiller expansion valve 14*c* in the regulated state, the chiller 20, the accumulator 23, and the suction port of the compressor 11. That is, the refrigerant circuit is switched to a refrigerant circuit in which outside heat exchanger 15, the inside evaporator 18 and the chiller 20 are connected in parallel to the flow of the refrigerant.

In the low-temperature heating medium circuit 30 in the chilling and parallel-dehumidifying-heating mode, the control device 60 controls the operation of the low-temperature pump 31 in a manner similar to the chilling and cooling mode. Consequently, in the low-temperature heating medium circuit 30 in the chilling and serial-dehumidifying-heating mode, the low-temperature heating medium circulates as in the chilling and cooling mode.

In the inside air-conditioning unit 50 in the chilling and parallel-dehumidifying-heating mode, as in the cooling-only mode, the control device 60 controls the blowing capability of the inside blower 52, the opening of the air mix door 54, the inside-outside air switching device 53, and the operation of the blowing-mode door. The control device 60 also properly controls the operations of the other control target devices.

Therefore, in the heat pump cycle 10 in the chilling and parallel-dehumidifying-heating mode, the refrigeration cycle of the vapor compression type is configured in which the inside condenser 13 is made function as a condenser, and the outside heat exchanger 15, the inside evaporator 18 and the chiller 20 are made function as an evaporator.

In the low-temperature heating medium circuit 30 in the chilling and parallel-dehumidifying-heating mode, as in the chilling and cooling mode, the low-temperature heating medium chilled by the chiller 20 passes through the cooling water passage 70*a* in the battery 70, thereby cooling the battery 70.

In the inside air-conditioning unit 50 in the chilling and parallel-dehumidifying-heating mode, as in the parallel-dehumidifying-heating-only mode, the blown air subjected to the temperature adjustment is blown into the compartment, thereby realizing dehumidification and heating in the compartment.

(d) Heating Mode

A heating mode is an operation mode of heating the inside of the compartment by blowing heated air into the compartment. In the control program of the embodiment, mainly, when the outside temperature Tam is a relatively low value like in winter (in the embodiment, lower than 0° C.), the heating mode is selected.

The heating mode includes a heating-only mode of heating the inside of the compartment without cooling the battery 70 and a chilling and heating mode of chilling the battery 70 and also heating the inside of the compartment.

(d-1) Heating-Only Mode

In the heat pump cycle 10 in the heating-only mode, the control device 60 sets the heating expansion valve 14*a* in a regulated state, sets the cooling expansion valve 14*b* in a regulated state, sets the chiller expansion valve 14*c* in a fully closed state, sets the bypass flow-rate adjustment valve 14*d* in a fully closed state, and sets the defrosting flow-rate adjustment valve 14*e* in a fully open state. The control device 60 closes the dehumidifying on-off valve 22*a*.

Consequently, in the heat pump cycle 10 in the heating-only mode, the refrigerant circuit is switched to a refrigerant circuit in which the refrigerant discharged from the condenser 11 circulates, in order, the inside condenser 13, the heating expansion valve 14*a* in the regulated state, the outside heat exchanger 15, the heating passage 21*c*, the accumulator 23, and the suction port of the compressor 11.

In the inside air-conditioning unit 50 in the heating-only mode, as in the cooling-only mode, the control device 60 controls the blowing capability of the inside blower 52, the opening of the air mix door 54, the inside-outside air switching device 53, and the operation of the blowing-mode door. The control device 60 also properly controls the operations of the other control target devices.

Therefore, in the heat pump cycle 10 in the heating-only mode, the refrigeration cycle of the vapor compression type in which the inside condenser 13 is made function as a condenser and the outside heat exchanger 15 is made function as an evaporator is configured.

In the inside air-conditioning unit 50 in the heating-only mode, the air blown from the inside blower 52 passes through the inside evaporator 18. The blown air passed through the inside evaporator 18 is heated by the inside condenser 13 so that the temperature comes close to the target blowing temperature TAO in accordance with the opening of the air mix door 54. When the air subjected to temperature adjustment is blown into the compartment, heating in the compartment is realized.

(d-2) Chilling and Heating Mode

In the heat pump cycle 10 in the chilling and heating mode, in contrast to the heating-only mode, the control device 60 sets the chiller expansion valve 14*c* in a regulated state. The control device 60 also opens the dehumidifying on-off valve 22*a*.

Therefore, in the heat pump cycle 10 in the chilling and heating mode, the refrigerant discharged from the compressor 11 circulates in a manner similar to the heating-only mode. Simultaneously, the refrigerant circuit is switched to a refrigerant circuit in which the refrigerant discharged from the compressor 11 circulates, in order, the inside condenser 13, the dehumidification passage 21*b*, the chiller expansion valve 14*c* in the regulated state, the chiller 20, the accumulator 23, and the suction port of the compressor 11. That is, the refrigerant circuit is switched to a refrigerant circuit in which outside heat exchanger 15 and the chiller 20 are connected in parallel to the flow of the refrigerant.

In the low-temperature heating medium circuit 30 in the chilling and heating mode, the control device 60 controls the operation of the low-temperature pump 31 in a manner similar to the chilling and cooling mode. Consequently, in the low-temperature heating medium circuit 30 in the chilling and serial-dehumidifying-heating mode, the low-temperature heating medium circulates as in the chilling and cooling mode.

In the inside air-conditioning unit 50 in the chilling and heating mode, as in the cooling-only mode, the control device 60 controls the blowing capability of the inside blower 52, the opening of the air mix door 54, the inside-outside air switching device 53, and the operation of the blowing-mode door. The control device 60 also properly controls the operations of the other control target devices.

Therefore, in the heat pump cycle 10 in the chilling and heating mode, the refrigeration cycle of the vapor compression type is configured in which the inside condenser 13 is made function as a condenser, and the outside heat exchanger 15 and the chiller 20 are made function as an evaporator.

In the low-temperature heating medium circuit 30 in the chilling and heating mode, as in the chilling and cooling mode, the low-temperature heating medium chilled by the chiller 20 passes through the cooling water passage 70*a* in the battery 70, thereby cooling the battery 70.

In the inside air-conditioning unit 50 in the chilling and heating mode, as in the heating-only mode, when the air subjected to temperature adjustment is blown into the compartment, heating in the compartment is realized.

(e) Hot Gas Heating Mode

A hot gas heating mode is an operation mode of heating the inside of the compartment when the outside temperature Tam is extremely low temperature (in the embodiment, lower than −10° C.). In the control program of the embodiment, when the outside temperature Tam is the extremely low temperature and the air-conditioner switch is in the off state (OFF), the hot gas heating mode is selected.

Figure 5:
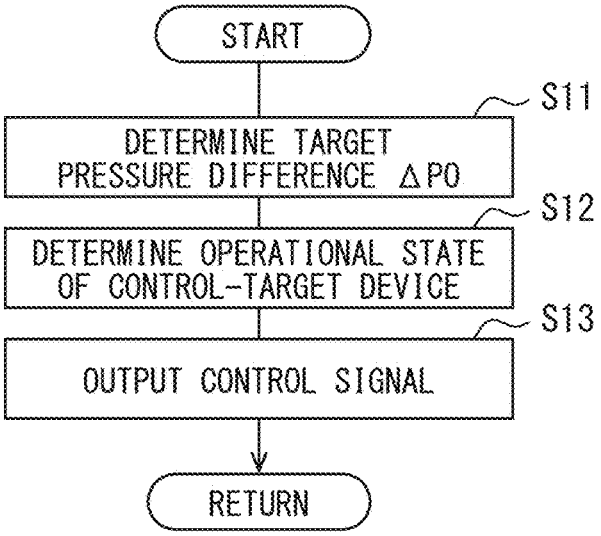
FIG. 5 is a flowchart of a subroutine of a control program of the first embodiment.

In the hot gas heating mode, a pressure difference control illustrated in the flowchart of FIG. 5 is executed. The flowchart of FIG. 5 denotes, when the operation mode in which the pressure difference control is executed is selected in step S4 in the main routine, a control process executed in step S5 as a subroutine.

In step S11 in FIG. 5, a target pressure difference ΔPO as a target value of a pressure difference ΔP is determined according to the operation mode selected. The pressure difference ΔP is a value obtained by subtracting the suctioned refrigerant pressure Ps detected by the suction refrigerant temperature-pressure sensor 62*f* from the discharged refrigerant pressure Pd detected by the discharge refrigerant temperature-pressure sensor 62*a*. Therefore, step S11 corresponds to a target pressure difference determining unit.

In step S11 in the hot gas heating mode, the target pressure difference ΔPO is determined on the basis of the target blowing temperature TAO with reference to the control map which is preliminarily stored in the control device 60. In the control map in the hot gas heating mode, the target pressure difference ΔPO is determined so as to increase as the target blowing temperature TAO rises.

In step S12, the operational state of each of the control target devices is determined in accordance with each of the operation modes. In step S13, a control signal is output from the control device 60 to each of the control target devices so that the device enters the operational state determined in step S12, and the program returns to the main routine.

In the heat pump cycle 10 in the hot gas heating mode, the control device 60 sets the heating expansion valve 14*a* in a full closed state, sets the cooling expansion valve 14*b* in a fully closed state, sets the chiller expansion valve 14*c* in a regulated state, sets the bypass flow-rate adjustment valve 14*d* in a regulated state, and sets the defrosting flow-rate adjustment valve 14*e* in a fully closed state. The control device 60 also opens the dehumidifying on-off valve 22*a*.

Figure 6:
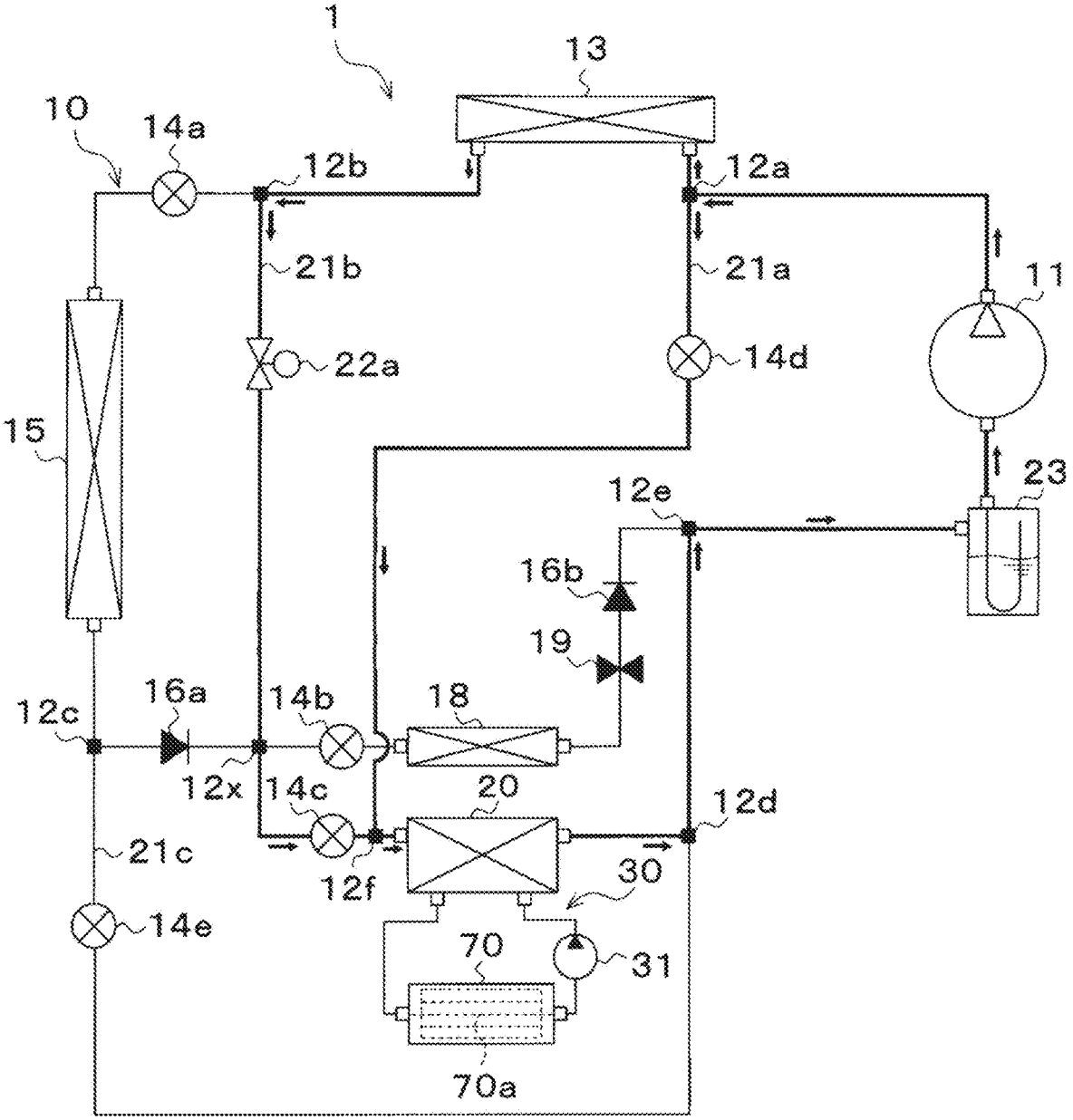
FIG. 6 is a schematic general configuration diagram illustrating the flow of a refrigerant in a hot gas heating mode of a heat pump cycle of the first embodiment.

Consequently, in the heat pump cycle 10 in the hot gas heating mode, as illustrated by the solid-line arrows in FIG. 6, the refrigerant discharged from the compressor 11 circulates, in order, the first three-way joint 12*a*, the inside condenser 13, the dehumidification passage 21*b*, the four-way joint 12*x*, the chiller expansion valve 14*c* in the regulated state, the sixth three-way joint 12*f*, the chiller 20, the accumulator 23, and the suction port of the compressor 11. Simultaneously, the refrigerant circuit is switched to a refrigerant circuit in which the refrigerant discharged from the compressor 11 circulates, in order, the first three-way joint 12*a*, the bypass flow-rate adjustment valve 14*d* provided for the bypass passage 21*a* which is in the regulated state, the sixth three-way joint 12*f*, the chiller 20, the accumulator 23, and the suction port of the compressor 11.

Therefore, the chiller expansion valve 14*c* in the hot gas heating mode corresponds to a heating-unit-side depressurizing unit which depressurizes the refrigerant which has flowed out from the inside condenser 13. The sixth three-way joint 12*f* in the hot gas heating mode corresponds to a mixing unit which mixes the refrigerant which has flowed out from the bypass flow-rate adjustment valve 14*d* and the refrigerant which has flowed out from the chiller expansion valve 14*c*.

The control device 60 also properly controls the operations of the other control target devices. Concretely, with respect to the compressor 11, the control device 60 controls the refrigerant discharge capability (that is, the rotational speed) of the compressor 11 so that the suctioned refrigerant pressure Ps comes close to a first target suctioned refrigerant pressure PSO1. More specifically, the control device 60 controls the refrigerant discharge capability of the compressor 11 by using a feedback control method by proportional-integral control.

The control to make the suctioned refrigerant pressure Ps come close to a predetermined value is effective to stabilize a discharge flow rate Gr (mass flow rate) of the compressor 11. More specifically, by setting the suctioned refrigerant pressure Ps to a saturated gas phase refrigerant having constant pressure, the density of the suctioned refrigerant becomes constant. Therefore, by controlling the suctioned refrigerant pressure Ps so as to come close to a constant pressure, the discharge flow rate Gr of the compressor 11 at the same rotational speed can be easily made stable.

The control device 60 adjusts the throttle opening of the chiller expansion valve 14*c* so that a subcooling degree SC1 of the refrigerant which has flowed out from the inside condenser 13 comes close to a first target subcooling degree SCO1. The subcooling degree SC1 can be obtained from the high-pressure refrigerant temperature T1 and the high-pressure refrigerant pressure P1 detected by the high-pressure refrigerant temperature-pressure sensor 62*b*.

The control device 60 adjusts the regulation opening of the bypass flow-rate adjustment valve 14*d* so that the pressure difference ΔP comes close to the target pressure difference ΔPO. More specifically, the control device 60 controls the operation of the bypass flow-rate adjustment valve 14*d* on the basis of the target pressure difference ΔPO by using the feed-forward control method.

The feed-forward control method at the time the control device 60 controls the operation of the bypass flow-rate adjustment valve 14*d* will be described. As described above, in the hot gas heating mode, the refrigerant discharge capability of the compressor 11 is controlled so that the suctioned refrigerant pressure Ps comes close to the first target suctioned refrigerant pressure PSO1. Consequently, density p of the suctioned refrigerant and the discharge flow rate Gr of the compressor 11 come close to constant values.

In the hot gas heating mode, by using the following formula F2, a throttle passage area Ab of the bypass flow-rate adjustment valve 14*d* at which the pressure difference ΔP becomes the target pressure difference ΔPO is estimated.

$$Gr = \rho \times Ab \times (2 \times \Delta PO/\rho)^{0.5} \quad \text{(F2)}$$

Gr denotes the discharge flow rate of the compressor 11. At the time of calculating the throttle passage area Ab, Gr is used as a constant value (const). The operation of the bypass flow-rate adjustment valve 14*d* is controlled so as to obtain the throttle passage area Ab estimated by using the formula F2.

Therefore, at the time of increasing the present pressure difference ΔP, the throttle opening of the bypass flow-rate adjustment valve 14*d* is decreased. At the time of decreasing the present pressure difference ΔP, the throttle opening of the bypass flow-rate adjustment valve 14*d* is increased.

In the low-temperature heating medium circuit 30 in the hot gas heating mode, the control device 60 stops the low-temperature pump 31.

In the inside air-conditioning unit 50 in the hot gas heating mode, as in the cooling-only mode, the control device 60 controls the blowing capability of the inside blower 52, the opening of the air mix door 54, and the operation of the blowing-mode door. In the hot gas heating mode, in many cases, the control device 60 controls the opening of the air mix door 54 so that most of the full volume of the air blown from the inside blower 52 passes through the inside condenser 13.

The control device 60 also controls the operation of the inside-outside air switching device 53 so as to introduce the inside air into the air-conditioning case 51.

Figure 7:
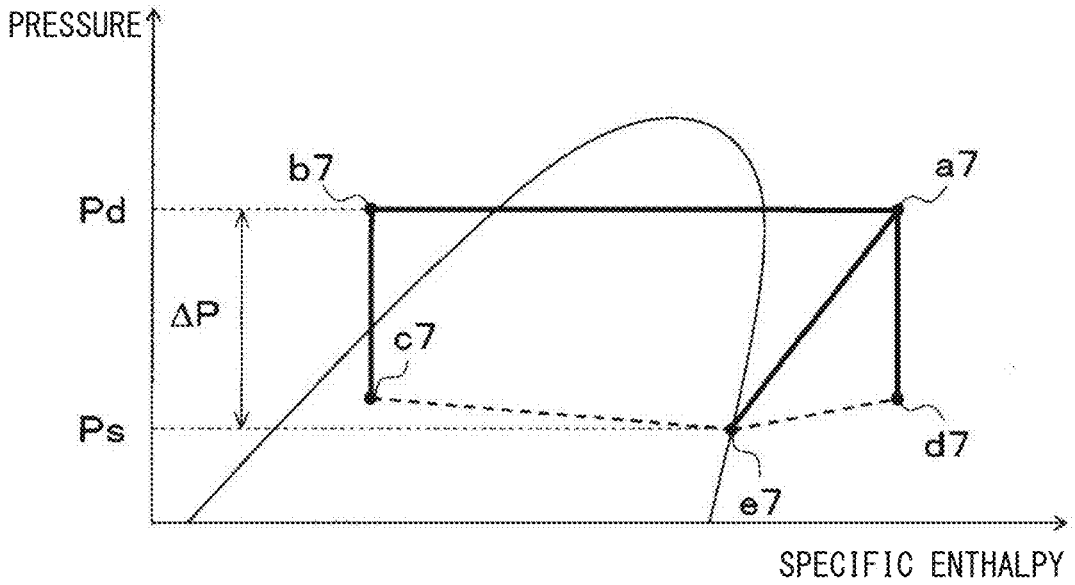
FIG. 7 is a Mollier diagram illustrating changes in the state of the refrigerant in the hot gas heating mode of the heat pump cycle of the first embodiment.

Therefore, in the heat pump cycle 10 in the hot gas heating mode, the state of the refrigerant changes as illustrated in the Mollier diagram of FIG. 7.

Specifically, the flow of the discharged refrigerant (point a7 in FIG. 7) from the compressor 11 is branched by the first three-way joint 12*a*. One of the refrigerants branched by the first three-way joint 12*a* flows in the inside condenser 13 and radiates heat to the blown air which passed through the inside evaporator 18 (from the point a7 to point b7 in FIG. 7). As a result, the blown air is heated.

The refrigerant which has flowed out from the inside condenser 13 flows in the dehumidification passage 21*b*. Since the cooling expansion valve 14*b* is in the fully closed state, the refrigerant which has flowed into the dehumidification passage 21*b* flows in the chiller expansion valve 14*c* and is depressurized (from point b7 to point c7 in FIG. 7). The refrigerant having relatively low enthalpy which has flowed out from the chiller expansion valve 14*c* flows in the other inflow port of the sixth three-way joint 12*f*.

The other refrigerant branched by the first three-way joint 12*a* flows in the bypass passage 21*a*. The refrigerant which has flowed into the bypass passage 21*a* is subjected to flow-rate adjustment and depressurization by the bypass flow-rate adjustment valve 14*d* (from point a7 to point d7 in FIG. 7). The refrigerant having relatively high enthalpy depressurized by the bypass flow-rate adjustment valve 14*d* flows in one of the inflow ports of the sixth three-way joint 12*f*.

The refrigerant which has flowed out from the bypass flow-rate adjustment valve 14*d* and the refrigerant which has flowed out from the chiller expansion valve 14*c* are mixed by the sixth three-way joint 12*f*. The refrigerant which has flowed out from the sixth three-way joint 12*f* flows in the chiller 20. Since the low-temperature pump 31 is stopped in the hot gas heating mode, the refrigerant which has flowed into the chiller 20 is mixed uniformly by the chiller 20 without being heat-exchanged with the low-temperature heating medium at the time of passing through the refrigerant passage (point e7 in FIG. 7).

The refrigerant which has flowed out from the refrigerant passage of the chiller 20 flows in the accumulator 23. The vapor-phase refrigerant separated by the accumulator 23 is suctioned in the compressor 11 and compressed again.

In the inside air-conditioning unit 50 in the hot gas heating mode, the blown air which passed through the inside evaporator 18 is heated by the inside condenser 13 and blown into the compartment. In such a manner, the heating in the compartment is realized.

The hot gas heating mode is an operation mode executed when the outside temperature Tam is extremely low temperature. Consequently, when the refrigerant which has flowed out from the inside condenser 13 is allowed to flow in the outside heat exchanger 15, there is the possibility that the refrigerant radiates heat to the outside air in the outside heat exchanger 15. Further, when the low-temperature pump 31 is operating, there is the possibility that the refrigerant radiates heat to the low-temperature heating medium in the chiller 20.

When the refrigerant radiates heat to the outside air or the low-temperature heating medium, the heat radiation amount of the refrigerant to the blown air decreases in the inside condenser 13, and the blown air heating capability decreases.

To address it, in the hot gas heating mode of the embodiment, by using the refrigerant circuit in which the refrigerant which has flowed out from the inside condenser 13 is not allowed to flow in the outside heat exchanger 15, heat radiation of the refrigerant to the outside air in the outside heat exchanger 15 is suppressed. Further, by stopping the low-temperature pump 31, heat radiation of the refrigerant to the low-temperature heating medium in the chiller 20 is suppressed.

Therefore, in the hot gas heating mode, the heat generated by the work of the compressor 11 can be effectively used to heat the blown air. As a result, even when the outside temperature Tam is extremely low temperature, decrease in the blown air heating capability can be suppressed.

(f) Hot Gas Dehumidifying-Heating Mode

A hot gas dehumidifying-heating mode is an operation mode of dehumidifying-heating the inside of the compartment when the outside temperature Tam is extremely low temperature. In the control program of the embodiment, when the outside temperature Tam is extremely low temperature (lower than −10° C.) and the air conditioner switch is in the on state (ON), the hot gas dehumidifying-heating mode is selected.

A hot gas dehumidifying-heating mode is an operation mode of dehumidifying-heating the inside of the compartment when the outside temperature Tam is low temperature. In the control program of the embodiment, when the outside temperature Tam is low temperature (0° C. or higher and less than 10° C.) and the air conditioner switch is in the on state (ON), the hot gas dehumidifying-heating mode is selected.

In the hot gas dehumidifying-heating mode, as in the hot gas heating mode, the pressure difference control described with reference to FIG. 5 is executed. In step S11 in the hot gas dehumidifying-heating mode, as in the hot gas heating mode, the target pressure difference ΔPO is determined on the basis of the target blowing temperature TAO with reference to the control map which is preliminarily stored in the control device 60.

In the control map in the hot gas dehumidifying-heating mode, the target pressure difference ΔPO is determined so as to increase as the target blowing temperature TAO rises.

Further, the target pressure difference ΔPO determined by the control map in the hot gas dehumidifying-heating mode becomes a value equal to or larger than the target pressure difference ΔPO determined by the control map in the hot gas heating mode when the target blowing temperature TAO is the same.

In the heat pump cycle 10 in the hot gas dehumidifying-heating mode, the control device 60 sets the heating expansion valve 14*a* in a full closed state, sets the cooling expansion valve 14*b* in a regulated state, sets the chiller expansion valve 14*c* in a regulated state, sets the bypass flow-rate adjustment valve 14*d* in a regulated state, and sets the defrosting flow-rate adjustment valve 14*e* in a fully closed state. The control device 60 also opens the dehumidifying on-off valve 22*a*.

Figure 8:
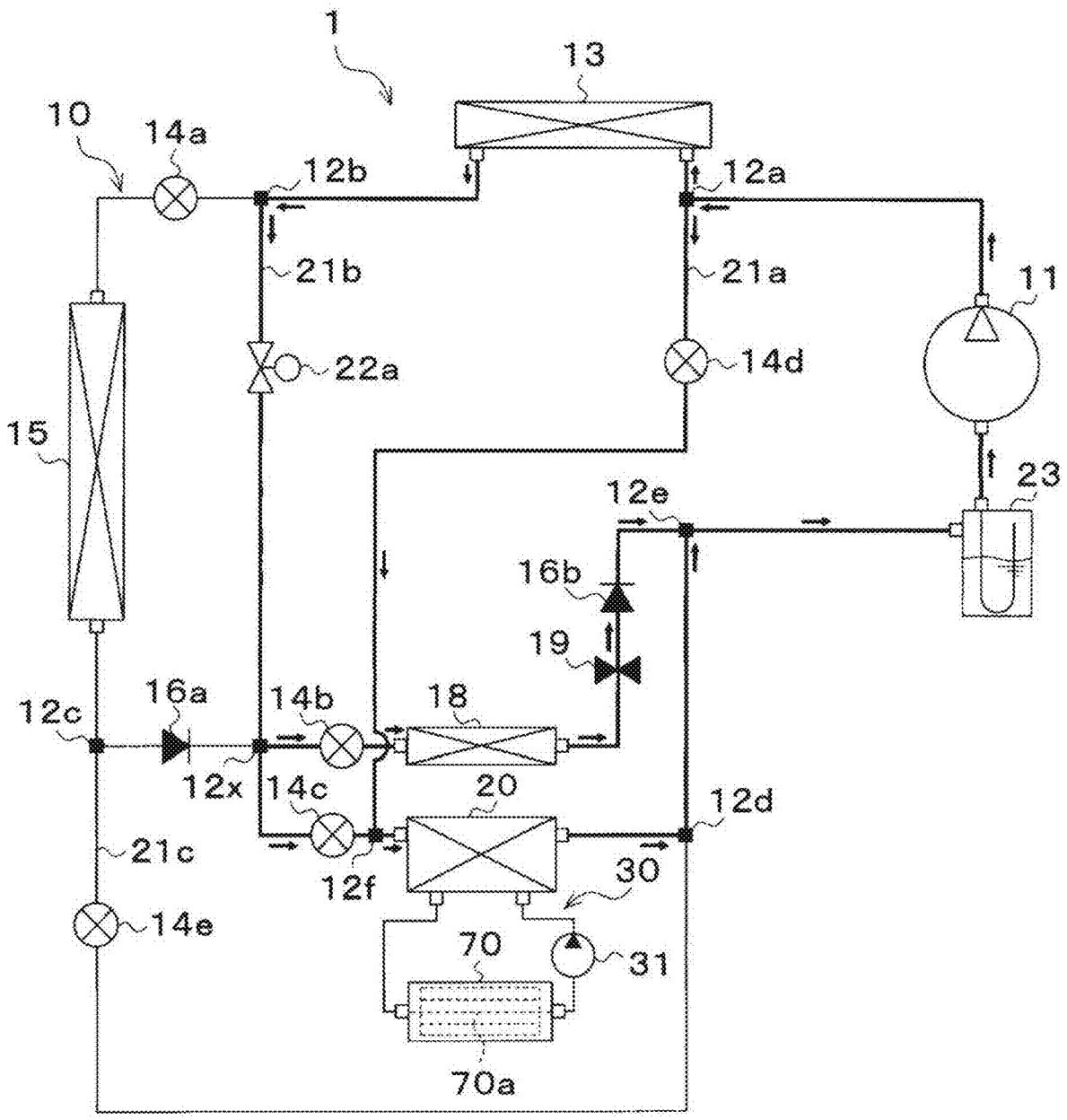
FIG. 8 is a schematic general configuration diagram illustrating the flow of a refrigerant in a hot gas dehumidifying-heating mode of a heat pump cycle of the first embodiment.

Consequently, in the heat pump cycle 10 in the hot gas dehumidifying-heating mode, as illustrated by the solid-line arrows in FIG. 8, the refrigerant discharged from the compressor 11 circulates in a manner similar to the hot gas heating mode. Simultaneously, the refrigerant circuit is switched to a refrigerant circuit in which the refrigerant discharged from the compressor 11 circulates, in order, the first three-way joint 12*a*, the inside condenser 13, the dehumidification passage 21*b*, the four-way joint 12*x*, the cooling expansion valve 14*b* in the regulated state, the inside evaporator 18, the evaporation pressure regulation valve 19, the accumulator 23, and the suction port of the compressor 11.

Therefore, the chiller expansion valve 14*c* in the hot gas dehumidifying-heating mode corresponds to a heating-unit-side depressurizing unit which depressurizing the refrigerant which has flowed out from the inside condenser 13 as a heating unit. The sixth three-way joint 12*f* in the hot gas dehumidifying-heating mode corresponds to a mixing unit which mixes the refrigerant which has flowed out from the bypass flow-rate adjustment valve 14*d* and the refrigerant which has flowed out from the chiller expansion valve 14*c*.

The control device 60 also properly controls the operations of the other control target devices. Concretely, with respect to the compressor 11, the control device 60 controls the refrigerant discharge capability (that is, the rotational speed) of the compressor 11 in a manner similar to the hot gas heating mode so that the suctioned refrigerant pressure Ps comes close to a second target suctioned refrigerant pressure PSO2. The second target suctioned refrigerant pressure PSO2 is set to a value equal to or lower than the first target suctioned refrigerant pressure PSO1 to realize secure dehumidification.

The control device 60 adjusts the throttle opening of the chiller expansion valve 14*c* so that a subcooling degree SC1 of the refrigerant which has flowed out from the inside condenser 13 comes close to a second target subcooling degree SCO2.

The control device 60 also adjusts the throttle opening of the cooling expansion valve 14*b* so as to be a predetermined throttle opening for the hot gas dehumidifying-heating mode.

The control device 60 also adjusts the throttle opening of the bypass flow-rate adjustment valve 14*d* so that the pressure difference ΔP comes close to the target pressure difference ΔPO by using the feed-forward control method in a manner similar to the hot gas heating mode.

In the low-temperature heating medium circuit 30 in the hot gas dehumidifying-heating mode, the control device 60 stops the low-temperature pump 31.

In the inside air-conditioning unit 50 in the hot gas dehumidifying-heating mode, as in the hot gas heating mode, the control device 60 controls the blowing capability of the inside blower 52, the opening of the air mix door 54, the inside-outside air switching device 53, and the operation of the blowing-mode door.

Figure 9:
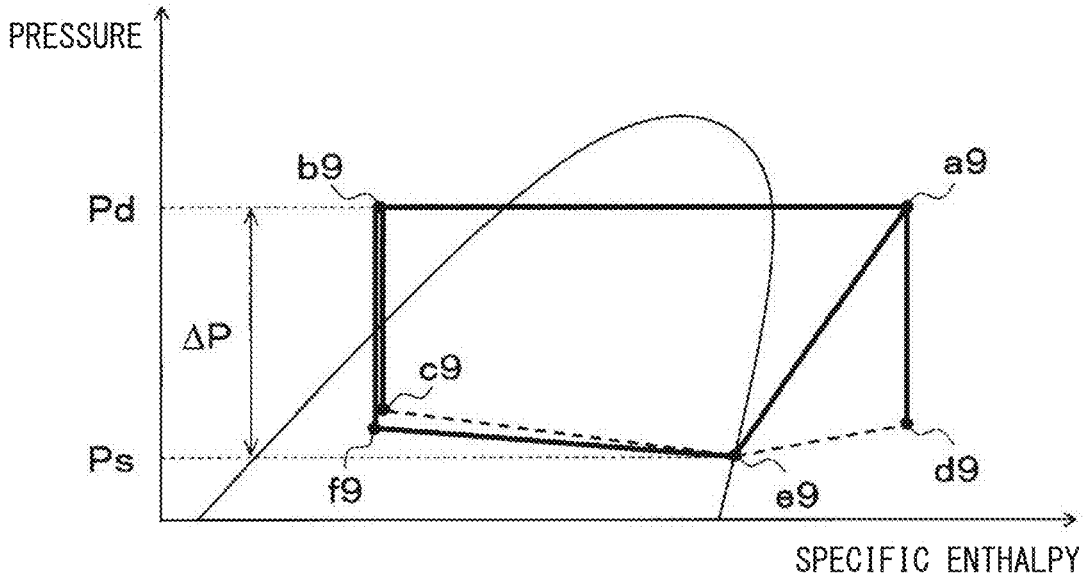
FIG. 9 is a Mollier diagram illustrating changes in the state of the refrigerant in the hot gas dehumidifying-heating mode of the heat pump cycle of the first embodiment.

Therefore, in the heat pump cycle 10 in the hot gas dehumidifying-heating mode, the state of the refrigerant changes as illustrated in the Mollier diagram of FIG. 9.

Specifically, the flow of the discharged refrigerant (point a9 in FIG. 9) from the compressor 11 is branched by the first three-way joint 12*a*. One of the refrigerants branched by the first three-way joint 12*a* flows in the inside condenser 13 and radiates heat to the blown air cooled and dehumidified by the inside evaporator 18 (from the point a9 to point b9 in FIG. 9). As a result, the blown air is heated again.

The refrigerant which has flowed out from the inside condenser 13 flows in one of the inflow ports of the four-way joint 12*x* via the dehumidification passage 21*b*.

The refrigerant which has flowed out from one of the outflow ports of the four-way joint 12*x* flows in the cooling expansion valve 14*b* and is depressurized (from point b9 to point f9 in FIG. 9). The refrigerant depressurized by the cooling expansion valve 14*b* flows in the inside evaporator 18. The refrigerant which has flowed into the inside evaporator 18 heat-exchanges with the air (the inside air in the embodiment) blown from the inside blower 52 and evaporates (from point f9 to point e9 in FIG. 9). In such a manner, the air blown from the inside blower 52 is cooled and dehumidified.

The refrigerant which has flowed out from the inside evaporator 18 flows in the fifth three-way joint 12*e* via the evaporation pressure regulation valve 19 and the second check valve 16*b*.

The refrigerant which has flowed out from another outflow port of the four-way joint 12*x* flows in the chiller expansion valve 14*c* and depressurized in a manner similar to the hot gas heating mode (from point b9 to point c9 in FIG. 9). The refrigerant depressurized by the chiller expansion valve 14*c* flows in the other inflow port of the sixth three-way joint 12*f* in a manner similar to the hot gas heating mode.

Although the pressure of the refrigerant (point d9 in FIG. 9) depressurized by the chiller expansion valve 14*c* is set to a value higher than the pressure of the refrigerant (point f9 in FIG. 9) depressurized by the cooling expansion valve 14*b* for clarification of the diagram in FIG. 9, the present disclosure is not limited to the case. The pressure of the refrigerant depressurized by the chiller expansion valve 14*c* may be a value equal to or lower than the pressure of the refrigerant depressurized by the cooling expansion valve 14*b*.

The other refrigerant branched by the first three-way joint 12*a* is subjected to the flow rate adjustment and depressurization by the bypass flow-rate adjustment valve 14*d* provided for the bypass passage 21*a* (from point a9 to point d9 in FIG. 9). The refrigerant depressurized by the bypass flow-rate adjustment valve 14*d* flows in one of the inflow port of the sixth three-way joint 12*f* in a manner similar to the hot gas heating mode.

The refrigerant which has flowed out from the bypass flow-rate adjustment valve 14*d* and the refrigerant which has flowed out from the chiller expansion valve 14*c* are mixed by the sixth three-way joint 12*f* in a manner similar to the hot gas heating mode. Further, the refrigerant which has flowed out from the sixth three-way joint 12*f* to the chiller 20 is mixed uniformly in the chiller 20. The refrigerant which has flowed out from the chiller 20 flows in the fifth three-way joint 12*e*.

In the fifth three-way joint 12*e*, the flow of the refrigerant which has flowed out from the inside evaporator 18 and the flow of the refrigerant which has flowed out from the chiller 20 are merged. The refrigerant which has flowed out from the fifth three-way joint 12*e* flows in the accumulator 23. The vapor-phase refrigerant separated by the accumulator 23 is suctioned in the compressor 11 and compressed again.

In the inside air-conditioning unit 50 in the hot gas dehumidifying-heating mode, the blown air cooled and dehumidified in the inside evaporator 18 is re-heated by the inside condenser 13 and blown into the compartment. In such a manner, the dehumidification and heating in the compartment is realized.

Therefore, in the hot gas dehumidifying-heating mode, in a manner similar to the hot gas heating mode, the heat generated by the work of the compressor 11 can be effectively used to heat the blown air. Further, the heat absorbed by the refrigerant from the blown air in the inside evaporator 18 can be used to heat the blown air. As a result, in the hot gas dehumidifying-heating mode, even when the outside temperature Tam is low temperature, decrease in the capability of heating the blown air can be suppressed.

(g) Chilling-Only Mode

A chilling-only mode is an operation mode of chilling the battery 70 without performing air conditioning in the compartment.

In the heat pump cycle 10 in the heating-only mode, the control device 60 sets the heating expansion valve 14*a* in a full open state, sets the cooling expansion valve 14*b* in a fully closed state, sets the chiller expansion valve 14*c* in a regulated state, sets the bypass flow-rate adjustment valve 14*d* in a fully closed state, and sets the defrosting flow-rate adjustment valve 14*e* in a fully closed state. The control device 60 closes the dehumidifying on-off valve 22*a*.

Consequently, in the heat pump cycle 10 in the chilling-only mode, the refrigerant circuit is switched to a refrigerant circuit in which the refrigerant discharged from the compressor 11 circulates, in order, the inside condenser 13, the heating expansion valve 14*a* in the fully open state, the outside heat exchanger 15, the chiller expansion valve 14*c* in the regulated state, the chiller 20, the accumulator 23, and the suction port of the compressor 11.

In the low-temperature heating medium circuit 30 in the chilling-only mode, the control device 60 makes the low-temperature pump 31 operate in a manner similar to the cooling and chilling mode. Consequently, in the low-temperature heating medium circuit 30, the low-temperature heating medium which is pressure-fed from the low-temperature pump 31 circulates like in the chilling and cooling mode.

In the inside air-conditioning unit 50 in the chilling-only mode, the control device 60 stops the inside blower 52.

Therefore, in the heat pump cycle 10 in the chilling-only mode, the refrigeration cycle of the vapor compression type is configured in which the outside heat exchanger 15 is made function as a condenser, and the chiller 20 is made function as an evaporator.

In the low-temperature heating medium circuit 30 in the chilling-only mode, as in the chilling and cooling mode, the low-temperature heating medium chilled by the chiller 20 passes through the cooling water passage 70*a* in the battery 70, thereby cooling the battery 70.

(h) Warming-Up-Only Mode

A warming-up-only mode is an operation mode of warming up the battery 70. In the control program of the embodiment, when the IG switch is set to a turn-on state (ON) in a state where the battery temperature TB is equal to or lower than a reference warm-up temperature KTBL1 which is preliminarily determined, the warming-up-only mode is selected.

In the warming-up-only mode, like in the hot gas heating mode, the pressure difference control described with reference to FIG. 5 is executed. In step S11 in the warming-up-only mode, the target pressure difference ΔPO is determined on the basis of the outside temperature Tam with reference to a control map which is preliminarily stored in the control device 60. In the control map in the warming-up-only mode, the target pressure difference ΔPO is determined so as to increase as the outside temperature Tam decreases.

In the heat pump cycle 10 in the warming-up-only mode, the control device 60 sets the heating expansion valve 14*a* in a full closed state, sets the cooling expansion valve 14*b* in a fully closed state, sets the chiller expansion valve 14*c* in a regulated state, sets the bypass flow-rate adjustment valve 14*d* in a fully closed state, and sets the defrosting flow-rate adjustment valve 14*e* in a fully closed state. The control device 60 also opens the dehumidifying on-off valve 22*a*.

Figure 10:
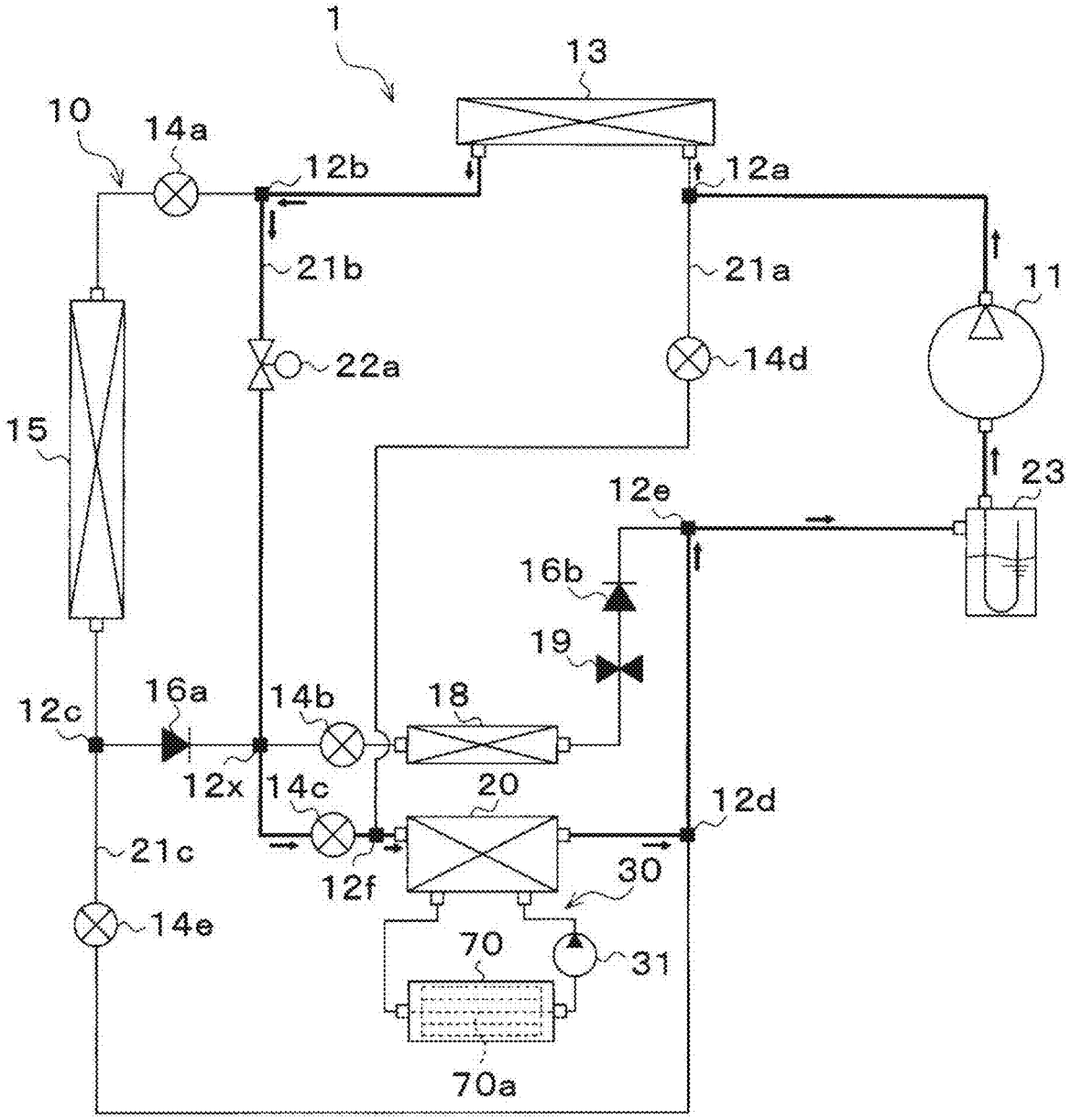
FIG. 10 is a schematic general configuration diagram illustrating the flow of a refrigerant in a heating-only mode of a heat pump cycle of the first embodiment.

Therefore, in the heat pump cycle 10 in the warming-up-only mode, as illustrated by the solid-line arrows in FIG. 10, the refrigerant circuit is switched to a refrigerant circuit in which the refrigerant discharged from the compressor 11 circulates, in order, the inside condenser 13, the dehumidification passage 21*b*, the chiller expansion valve 14*c* in the regulated state, the chiller 20, the accumulator 23, and the suction port of the compressor 11.

The control device 60 also properly controls the operations of the other control target devices. Concretely, with respect to the compressor 11, the control device 60 controls the refrigerant discharge capability (that is, the rotational speed) of the compressor 11 so that the discharge refrigerant pressure Pd comes close to the target discharge refrigerant pressure PDO1 in the warming-up-only mode like in the hot gas heating mode.

The control device 60 also adjusts the throttle opening of the chiller expansion valve 14*c* so that the pressure difference ΔP comes close to the target pressure difference ΔPO by using the feed-forward control method in a manner similar to the hot gas heating mode.

In the low-temperature heating medium circuit 30 in the warming-up-only mode, the control device 60 controls the operation of the low-temperature pump 31 like in the chilling and cooling mode. Consequently, in the low-temperature heating medium circuit 30 in the chilling and serial-dehumidifying-heating mode, the low-temperature heating medium circulates as in the chilling and cooling mode.

In the inside air-conditioning unit 50 in the warming-up-only mode, the control device 60 stops the inside blower 52.

Figure 11:
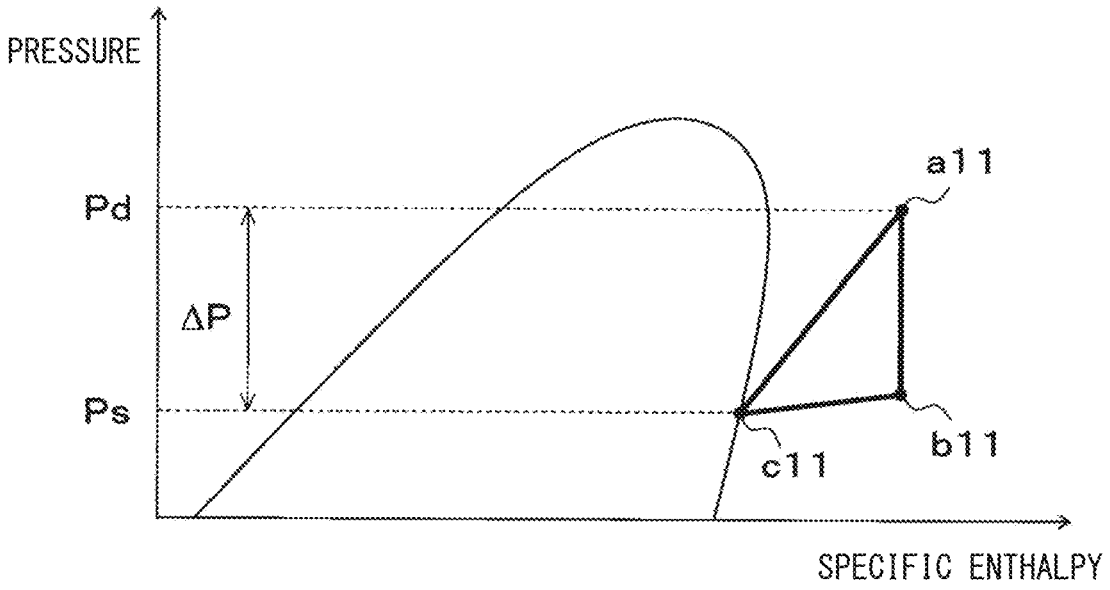
FIG. 11 is a Mollier diagram illustrating changes in the state of the refrigerant in the warming-up-only mode of the heat pump cycle of the first embodiment.

Therefore, in the heat pump cycle 10 in the warming-up-only mode, the state of the refrigerant changes as illustrated in the Mollier diagram of FIG. 11.

Specifically, the discharged refrigerant (point a11 in FIG. 11) from the compressor 11 flows in the chiller expansion valve 14*c* and is depressurized (from point a11 to point b11 in FIG. 11) via the inside condenser 13 and the dehumidification passage 21*b*. In the warming-up-only mode, since the inside blower 52 stops, the refrigerant does not radiate heat to the blown air in the inside condenser 13.

The refrigerant which has flowed out from the chiller expansion valve 14*c* flows in the refrigerant passage in the chiller 20. The refrigerant which has flowed into the refrigerant passage in the chiller 20 radiates heat to the low-temperature heating medium passing through the heating medium passage in the chiller 20 (from point b11 to point c11 in FIG. 11). As a result, the low-temperature heating medium is heated. The refrigerant which has flowed out from the chiller 20 flows in the accumulator 23. The vapor-phase refrigerant separated by the accumulator 23 is suctioned in the compressor 11 and compressed again.

In the low-temperature heating medium circuit 30 in the warming-up-only mode, the low-temperature heating medium which is pressure-fed from the low-temperature pump 31 flows in the chiller 20 and is heated. The low-temperature heating medium heated by the chiller 20 passes through the cooling water passage 70*a* in the battery 70, thereby warming up the battery 70.

As obvious from the above description, the chiller expansion valve 14*c* in the warming-up-only mode corresponds to an upstream depressurizing unit. The battery 70 in the warming-up-only mode is a low-pressure heating target. Each of devices constructing the chiller 20 and the low-temperature heating medium circuit 30 in the warming-up-only mode is a low-pressure heating unit. The warming-up-only mode may be finished when the battery temperature TB becomes equal to or higher than warm-up termination KTBL2 which is preliminarily determined.

(i) Defrosting Mode

A defrosting mode is an operation mode executed to remove frost attached to the outside heat exchanger 15. In the control program of the embodiment, when it is determined that a frost formation condition is satisfied during execution of the parallel dehumidifying-heating mode and the heating mode, the defrosting mode is selected.

The frost formation condition of the embodiment is satisfied when time in which the outside-device refrigerant temperature T2 detected by the outside-device refrigerant temperature-pressure sensor 62*c* is equal to or lower than reference frost formation temperature KTDF (in the embodiment, −5° C.) becomes reference frost formation time KTmDF (in the embodiment, five minutes) or longer during execution of the parallel dehumidifying-heating mode and the heating mode.

In the defrosting mode, like in the hot gas heating mode, the pressure difference control described with reference to FIG. 5 is executed. In step S11 in the defrosting mode, the target pressure difference ΔPO is determined on the basis of the outside temperature Tam with reference to a control map which is preliminarily stored in the control device 60. In the control map in the defrosting mode, the target pressure difference ΔPO is determined so as to increase as the outside temperature Tam decreases.

In the heat pump cycle 10 in the defrosting mode, the control device 60 sets the heating expansion valve 14*a* in a full open state, sets the cooling expansion valve 14*b* in a fully closed state, sets the chiller expansion valve 14*c* in a fully closed state, sets the bypass flow-rate adjustment valve 14*d* in a fully closed state, and set the defrosting flow-rate adjustment valve 14*e* in a regulated state. The control device 60 closes the dehumidifying on-off valve 22*a*.

Figure 12:
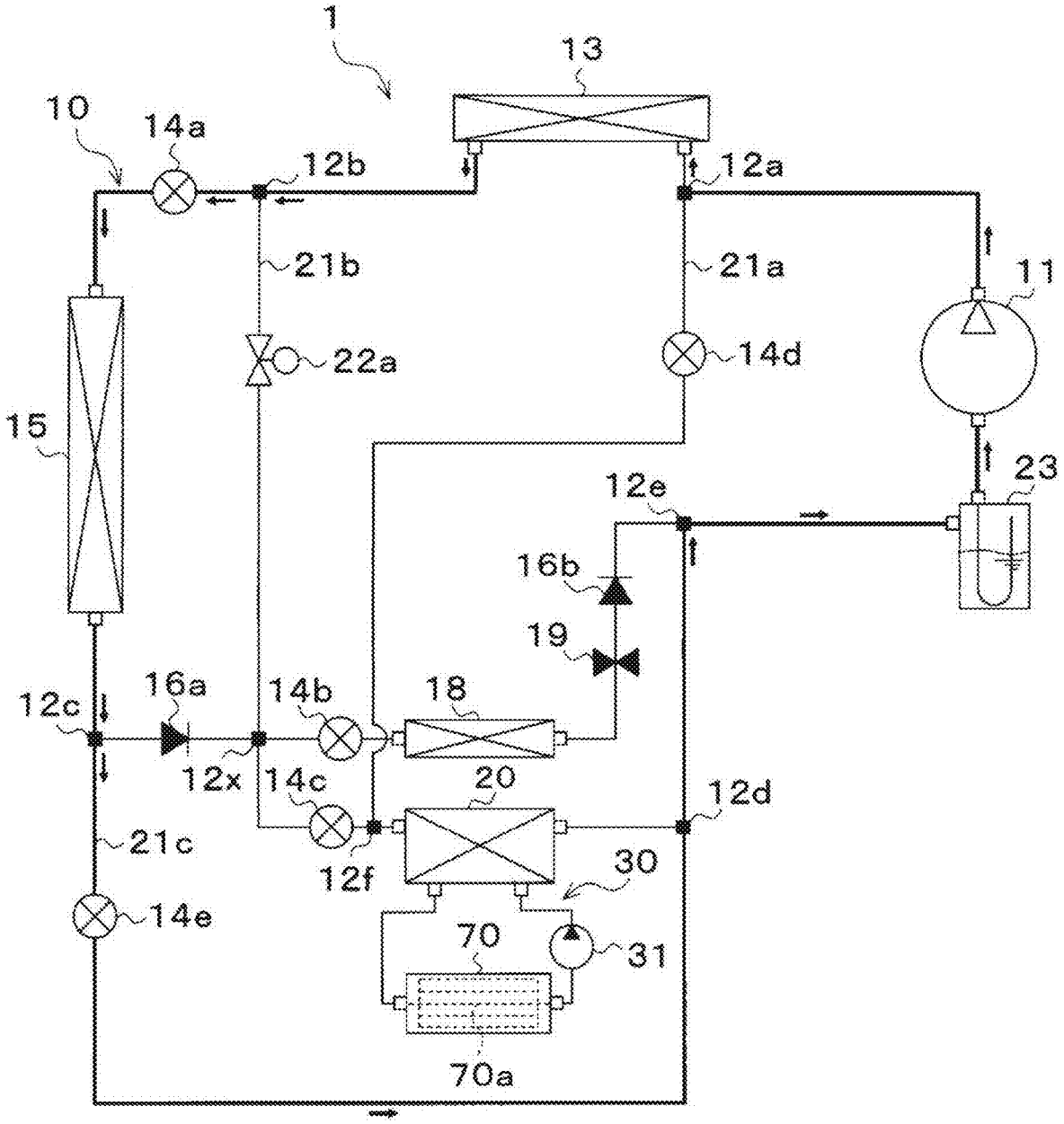
FIG. 12 is a schematic general configuration diagram illustrating the flow of a refrigerant in a defrosting mode of a heat pump cycle of the first embodiment.

Therefore, the heat pump cycle 10 in the defrosting mode, as illustrated by the solid-line arrows in FIG. 12, the refrigerant circuit is switched to a refrigerant circuit in which the refrigerant discharged from the compressor 11 circulates, in order, the inside condenser 13, the heating expansion valve 14*a* in the fully open state, the outside heat exchanger 15, the defrosting flow-rate adjustment valve 14*e* provided for the heating passage 21*c* in a regulated state, the accumulator 23, and the suction port of the compressor 11.

The control device 60 also properly controls the operations of the other control target devices. Concretely, with respect to the compressor 11, the control device 60 controls the refrigerant discharge capability (that is, the rotational speed) of the compressor 11 so that the suctioned refrigerant pressure Ps comes close to the third target suctioned refrigerant pressure PSO3 in the defrosting mode like in the hot gas heating mode.

The control device 60 also adjusts the throttle opening of the defrosting flow-rate adjustment valve 14*e* so that the pressure difference ΔP comes close to the target pressure difference ΔPO by using the feed-forward control method in a manner similar to the hot gas heating mode.

In the inside air-conditioning unit 50 in the defrosting mode, the control device 60 stops the inside blower 52.

Figure 13:
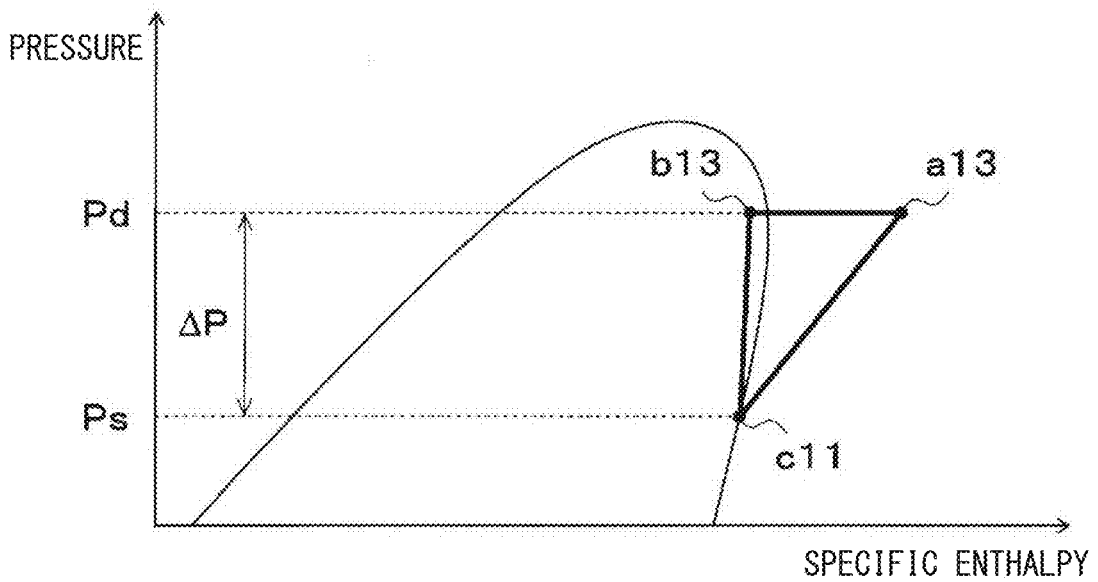
FIG. 13 is a Mollier diagram illustrating changes in the state of the refrigerant in the defrosting mode of the heat pump cycle of the first embodiment.

Therefore, in the heat pump cycle 10 in the defrosting mode, the state of the refrigerant changes as illustrated in the Mollier diagram of FIG. 13.

That is, the discharged refrigerant (point a13 in FIG. 13) discharged from the compressor 11 flows in the outside heat exchanger 15 via the inside condenser 13. In the defrosting mode, since the inside blower 52 stops, the refrigerant does not radiate heat to the blown air in the inside condenser 13.

The refrigerant which flows in the outside heat exchanger 15 radiates heat to the frost attached to the outside heat exchanger 15 (from point a13 to point b13 in FIG. 13). As a result, the frost attached on the outside heat exchanger 15 is melted, and defrosting of the outside heat exchanger 15 is realized. The refrigerant which has flowed out from the outside heat exchanger 15 flows in the defrosting flow-rate adjustment valve 14*e* provided for the heating passage 21*c* and is depressurized (from point b13 to point c13 in FIG. 13).

The refrigerant which has flowed out from the defrosting flow-rate adjustment valve 14*e* flows in the accumulator 23. The vapor-phase refrigerant separated by the accumulator 23 is suctioned in the compressor 11 and compressed again.

As obvious from the above description, the outside heat exchanger 15 in the defrosting mode is a high-pressure heating unit. The frost attached to the outside heat exchanger 15 is a high-pressure heating target. The defrosting flow-rate adjustment valve 14*e* in the defrosting mode is a downstream depressurizing unit. The defrosting mode may be finished when predetermined time lapses and shifted to the parallel dehumidifying-heating mode and the heating mode.

As described above, in the air conditioner 1 for a vehicle of the embodiment, by switching the operation mode, pleasant air conditioning in the compartment and proper temperature adjustment of the battery 70 as an in-vehicle device can be performed.

In the hot gas heating mode and the hot gas dehumidifying-heating mode of the air conditioner 1 for a vehicle of the embodiment, the blown air as a heating target is heated by using mainly heat generated by the work of the compressor 11. Consequently, in the hot gas heating mode and the hot gas dehumidifying-heating mode, it is necessary to properly control the operation of a control target device so that the work amount of the compressor 11 becomes a heat amount proper to heat the blown air.

For example, it is assumed that, in the cycle in which the suctioned refrigerant pressure Ps is controlled so as to come close to the target suctioned-refrigerant pressure POS, the refrigerant discharge capability of the compressor 11 is increased to increase the blown air heating capability of the inside condenser 13. In this case, there is the possibility that the cycle cannot be operated stably.

More specifically, when the refrigerant discharge capability of the compressor 11 is increased, the heat amount supplied to the suctioned refrigerant via the bypass passage

21*a* increases, so that the suctioned refrigerant pressure Ps rises. It is therefore considered to reduce the throttle opening of the bypass flow-rate adjustment valve 14*d* to decrease the heat amount supplied to the suctioned refrigerant so that the suctioned refrigerant pressure Ps comes close to the target suctioned refrigerant pressure PSO.

However, even if the suctioned refrigerant pressure Ps can be made close to the target suctioned refrigerant pressure PSO by reducing the throttle opening of the bypass flow-rate adjustment valve 14*d*, when the supply of the heat amount of the discharged refrigerant which flows in the inside condenser 13 is excessive, the discharged refrigerant pressure Pd keeps on rising. As a result, cycle cannot be operated stably.

Similarly, for example, it is assumed that, in the cycle in which the discharge refrigerant pressure Pd is controlled so as to come close to the predetermined target discharge refrigerant pressure PDO, the refrigerant discharge capability of the compressor 11 is increased to increase the blown air heating capability of the inside condenser 13. In this case, also, there is the possibility that the cycle cannot be operated stably.

More specifically, when the refrigerant discharge capability of the compressor 11 is increased, the heat amount of the discharged refrigerant which flows in the inside condenser 13 increases, so that the discharged refrigerant pressure Pd rises. It is therefore considered to increase the threshold opening of the bypass flow-rate adjustment valve 14*d* to decrease the heat amount of the discharged refrigerant which flows in the inside condenser 13 so that the discharged refrigerant pressure Pd comes close to the target discharge refrigerant pressure PDO.

However, even if the discharged refrigerant pressure Pd can be made close to the target discharged refrigerant pressure PDO by increasing the throttle opening of the bypass flow-rate adjustment valve 14*d*, when the supply of the heat amount to the suctioned refrigerant is excessive, the suctioned refrigerant pressure Ps keeps on rising. As a result, cycle cannot be operated stably.

In contrast, in the hot gas heating mode or hot gas dehumidifying-heating mode of the air conditioner 1 for a vehicle of the embodiment, the operation of the bypass flow-rate adjustment valve 14*d* is controlled so that the pressure difference ΔP comes close to the target pressure difference ΔPO. Therefore, by properly determining the target pressure difference ΔPO, the work amount of the compressor 11 can be adjusted to the heat amount by which the blown air can be heated properly.

As a result, even in the operation mode of heating the blown air by using heat generated mainly by the work of the compressor as in the hot gas heating mode and the hot gas dehumidifying-heating mode, the cycle can be operated stably. That is, the stability of the operation at the time of heating blown air can be improved.

The target pressure difference determining unit of the embodiment determines the target pressure difference ΔPO so as to increase as the target blowing temperature TAO rises in the hot gas heating mode and the hot gas dehumidifying-heating mode. In such a manner, the work amount of the compressor 11 can be increased as the heating temperature of the blown air rises. Therefore, the target pressure difference ΔPO can be determined properly.

The discharge capability control unit 60*a* of the embodiment controls the operation of the compressor 11 so that the suctioned refrigerant pressure Ps comes close to each of the first target suctioned refrigerant pressure PSO1 and the second target suctioned refrigerant pressure PSO2 in the hot gas heating mode and the hot gas dehumidifying-heating mode.

In such a manner, in each of the operation modes, the discharge flow rate Gr of the compressor 11 can be stabilized. Therefore, by changing the target pressure difference ΔPO, the work amount of the compressor 11 can be adjusted more precisely.

The bypass control unit 60*c* of the embodiment controls the operation of the bypass flow-rate adjustment valve 14*d* by the feed-forward control. In such a manner, by promptly changing the work amount of the compressor 11, the blown air heating capability in the inside condenser 13 can be swiftly adjusted to a proper value.

In the heating-only mode of the air conditioner 1 for a vehicle of the embodiment, the battery 70 as a low pressure heating target is heated by using only the heat generated by the work of the compressor 11 without using heat absorbed from the outside air and the like. Consequently, in the warming-up-only mode, it is necessary to properly control the operation of a control target device so that the work amount of the compressor 11 becomes a proper heat amount for warming up the battery 70.

For example, it is assumed that, in the cycle in which the discharged refrigerant pressure Pd is controlled so as to come close to the predetermined target discharged refrigerant pressure PDO, the refrigerant discharge capability of the compressor 11 is increased to increase the heating capability of the battery 70 in the low-pressure heating unit configured by the chiller 20 and the low-temperature heating medium circuit 30. In this case, there is the possibility that the cycle cannot be operated stably.

More specifically, when the refrigerant discharge capability of the compressor 11 is increased, the discharged refrigerant pressure Pd rises. It is therefore considered to increase the throttle opening of the chiller expansion valve 14*c* as an upstream depressurizing unit to make the discharge refrigerant pressure Pd come close to the target discharge refrigerant pressure PDO.

When the throttle opening of the chiller expansion valve 14*c* is increased, the pressure of the refrigerant which flows in the chiller 20 rises, so that the pressure difference ΔP decreases. Due to this, the capability of heating the battery 70 in the low-pressure heating unit cannot be increased. As a result, the refrigerant discharge capability of the compressor 11 has to be further increased, and the cycle cannot be operated stably.

In contrast, in the warming-up-only mode of the air conditioner 1 for a vehicle of the embodiment, the operation of the chiller expansion valve 14*c* is controlled so that the pressure difference ΔP comes close to the target pressure difference ΔPO. Therefore, by properly determining the target pressure difference ΔPO, the work amount of the compressor 11 can be adjusted to the heat amount by which the battery 70 can be warmed up properly.

As a result, even in the operation mode of warning up the battery 70 by using only the heat generated by the work of the compressor like the warming-up-only mode, the cycle can be operated stably. That is, the stability of the operation at the time of warming up the battery 70 can be improved.

In the warming-up-only mode of the embodiment, the refrigerant which is depressurized by the chiller expansion valve 14*c* is allowed to flow in the chiller 20. In such a manner, in the warming-up-only mode, the refrigerant whose pressure is lower than that of the discharged refrigerant can be made flow in the chiller 20. Therefore, it is unnecessary to improve the pressure resistance of the chiller 20 for the purpose of executing the warming-up-only mode.

In the defrosting mode of the air conditioner 1 for a vehicle of the embodiment, the frost on the outside heat exchanger 15 as a high-pressure heating target is heated by using only the heat generated by the work of the compressor 11 without using heat absorbed from the outside air and the like. Consequently, in the defrosting mode, the operation of the control target device has to be properly controlled so that the work amount of the compressor 11 becomes a proper heat amount to heat the frost attached to the outside heat exchanger 15.

For example, it is assumed that, in the cycle in which the suctioned refrigerant pressure Ps is controlled so as to come close to the predetermined target suctioned-refrigerant pressure POS, the refrigerant discharge capability of the compressor 11 is increased to increase the capability of heating frost attached to the high-pressure heating unit configured by the outside heat exchanger 15. In this case, there is the possibility that the cycle cannot be operated stably.

More specifically, when the refrigerant discharge capability of the compressor 11 is increased, the suctioned refrigerant pressure Ps decreases. It is therefore considered to increase the throttle opening of the defrosting flow-rate adjustment valve 14*e* as a downstream depressurizing unit to make the suctioned refrigerant pressure Ps come close to the target suctioned refrigerant pressure PSO.

When the throttle opening of the defrosting flow-rate adjustment valve 14*e* is increased, the pressure of the refrigerant which flows in the outside heat exchanger 15 lowers, so that the pressure difference ΔP decreases. Consequently, the capability of heating frost attached to the high-pressure heating unit cannot be increased. As a result, the refrigerant discharge capability of the compressor 11 has to be further increased, and the cycle cannot be operated stably.

In contrast, in the defrosting mode of the air conditioner 1 for a vehicle of the embodiment, the operation of the defrosting flow-rate adjustment valve 14*e* is controlled so that the pressure difference ΔP comes close to the target pressure difference ΔPO. Therefore, by properly determining the target pressure difference ΔPO, the work amount of the compressor 11 can be adjusted to the heat amount by which outside heat exchanger 15 can be defrosted properly.

As a result, the cycle can be operated stably even in the operation mode of defrosting the outside heat exchanger 15 by using only the heat generated by the work of the compressor like the defrosting mode. That is, the stability of the operation at the time of defrosting the outside heat exchanger 15 can be improved.

In the defrosting mode of the air conditioner 1 for a vehicle of the embodiment, the air blown from the inside blower 52 may be heated by the inside condenser 13 and blown into the compartment. In such a manner, even in the defrosting mode, heating in the compartment can be continued.

Second Embodiment

In a second embodiment, an example of applying the heat pump cycle device according to the present disclosure to a stationary heating device 2 will be described. The heating device 2 of the embodiment has a heat pump cycle 10*a* and a control device 601.

Figure 14:
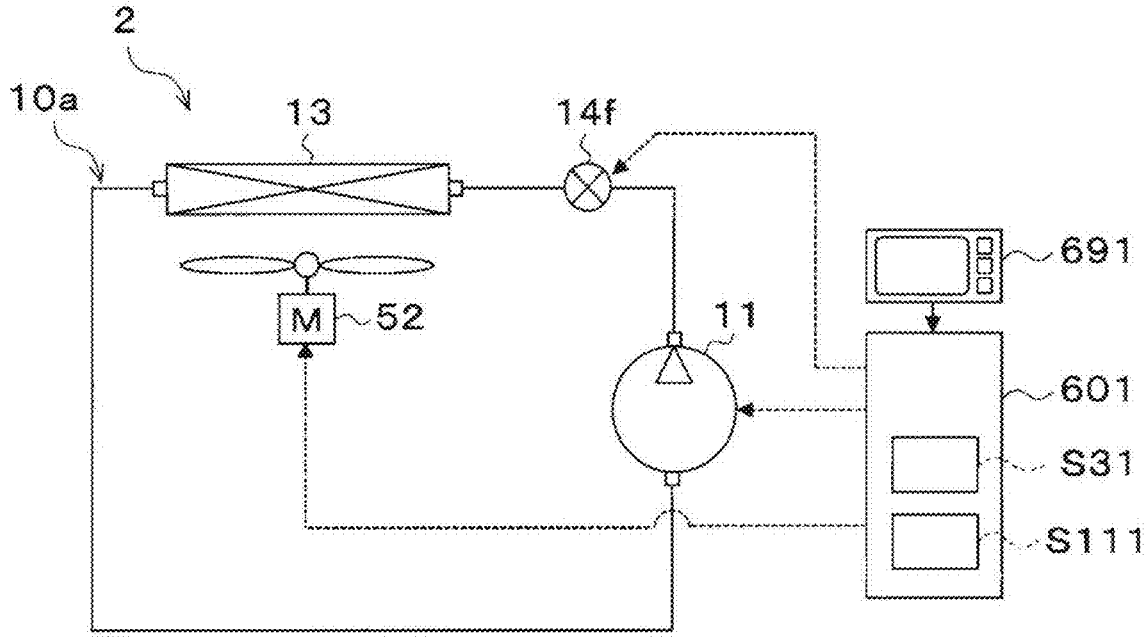
FIG. 14 is a schematic general configuration diagram of an air conditioner of a second embodiment.

The heat pump cycle 10*a* has, as illustrated in FIG. 14, the compressor 11, an upstream expansion valve 14*f*, and the inside condenser 13.

The upstream expansion valve 14*f* is an upstream depressurizing unit which depressurizes the discharge refrigerant. The basic configuration of the upstream expansion valve 14*f* is similar to that of the bypass flow-rate adjustment valve 14*d* or the like.

The inside condenser 13 of the embodiment is a heat exchanging unit for heating which performs heat exchange between the refrigerant which has flowed out from the upstream expansion valve 14*f* and the air blown from the inside blower 52 to the air-conditioning target space. In the inside condenser 13, the heat of the refrigerant which has flowed out from the upstream expansion valve 14*f* is radiated to the blown air to heat the blown air.

Therefore, the blown air of the embodiment is a low-pressure heating target. The inside condenser 13 is a low-pressure heating unit which heats the blown air by using a refrigerant which has flowed out from the bypass flow-rate adjustment valve 14*d* as a heat source and makes the refrigerant to flow toward the suction port side of the compressor 11.

The basic configuration of the control device 601 is similar to that of the control device 60 described in the first embodiment. The control device 601 of the embodiment has a target temperature determining unit S31 corresponding to step S3 of the control program described in the first embodiment, a target pressure difference determining unit S111 corresponding to step S11 of the control program, and the like.

Subsequently, the operation of the heating device 2 of the embodiment with the above-described configuration will be described. The basic operation of the heating device 2 of the embodiment is similar to the operation of the warming-up-only mode of the air conditioner 1 for a vehicle described in the first embodiment.

In the heating device 2, when the operation switch of an operation panel 691 connected to the control device 601 is turned on (ON), the control device 601 executes the control program. In the control program of the heating device 2, in a manner similar to the first embodiment, detection signals of a sensor group for control and an operation signal of the operation panel are read every predetermined cycle, and the target blowing temperature TAO and the target pressure difference ΔPO are determined.

Further, the control device 601 properly controls the operations of other control target devices so that the temperature of the air which is blown into a space to be air-conditioned becomes the target blowing temperature TAO.

Concretely, with respect to the compressor 11, the control device 601 controls the refrigerant discharge capability (that is, rotational speed) of the compressor 11 so that the suctioned refrigerant pressure Ps comes close to the target suctioned refrigerant pressure PSO like in the warming-up-only mode of the first embodiment.

In a manner similar to the warming-up-only mode of the first embodiment, the control device 601 adjusts the throttle opening of the upstream expansion valve 14*f* so that the pressure difference ΔP comes close to the target pressure difference ΔPO by using the feed-forward control method.

Therefore, in the heat pump cycle 10*a* of the heating device 2, the state of the refrigerant changes like in the Mollier diagram of FIG. 11 described in the warming-up-only mode of the first embodiment. Therefore, the air blown from the inside blower 52 is heat-exchanged with the refrigerant which has flowed out from the upstream expansion valve 14*f* and heated in the inside condenser 13. When the heated blown air is blown into the space to be air-conditioned, heating of the space to be air-conditioned is realized.

By the heating device 2 of the embodiment, an effect similar to that of the warming-up-only mode of the first embodiment can be obtained. That is, in the heating device 2 of the embodiment, even in the operation mode of heating the blown air using only the heat generated by the work of the compressor, the cycle can be operated stably. Moreover, the stability of the operation at the time of heating blown air as a low-pressure heating target can be improved.

Third Embodiment

In a third embodiment, an example of applying the heat pump cycle device according to the present disclosure to a stationary heating device 3 will be described. The heating device 3 of the embodiment has a heat pump cycle 10*b* and the control device 601.

Figure 15:
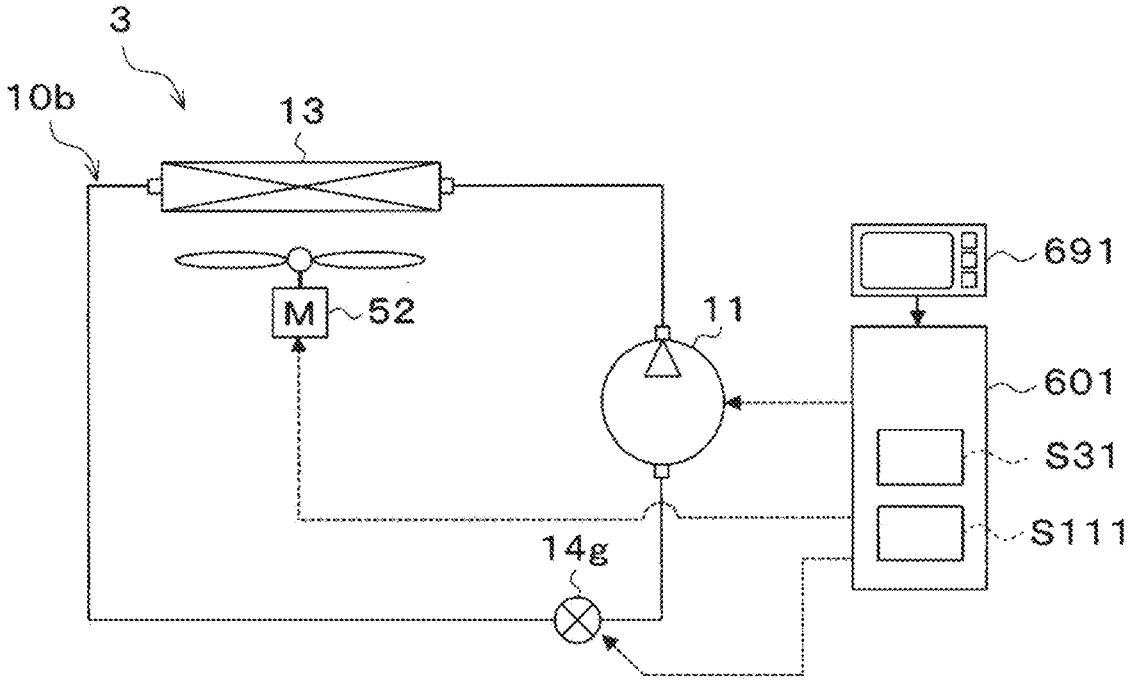
FIG. 15 is a schematic general configuration diagram of an air conditioner of a third embodiment.

The heat pump cycle 10*b* has as illustrated in FIG. 15, the compressor 11, the inside condenser 13, and a downstream expansion valve 14*g*.

The inside condenser 13 of the embodiment is a heat exchanging unit for heating, which performs heat exchange between the refrigerant discharged from the compressor 11 and the air blown from the inside blower 52 into the space to be air-conditioned. In the inside condenser 13, the heat of the discharged refrigerant is dissipated to the blown air, thereby heating the blown air.

The downstream expansion valve 14*g* is a downstream depressurizing unit which depressurizes the refrigerant which has flowed out from the inside condenser 13 and makes the resultant refrigerant to flow toward the suction port side of the compressor 11. The basic configuration of the downstream expansion valve 14*g* is similar to that of the bypass flow-rate adjustment valve 14*d* or the like.

Therefore the blown air of the embodiment is a high-pressure heating target. The inside condenser 13 is a high-pressure heating unit which heats blown air by using the discharged refrigerant as a heating source. A configuration equivalent to that of the second embodiment can be employed.

Subsequently, the operation of the heating device 3 of the embodiment with the above-described configuration will be described. The basic operation of the heating device 3 of the embodiment is similar to the operation of the defrosting mode of the air conditioner 1 for a vehicle described in the first embodiment.

In the heating device 3, when the operation switch of the operation panel 691 connected to the control device 601 is set to the turn-on state (ON), the control device 601 executes the control program. In the control program of the heating device 3, in a manner similar to the first embodiment, detection signals of a sensor group for control and an operation signal of the operation panel are read every predetermined cycle, and the target blowing temperature TAO and the target pressure difference ΔPO are determined.

Further, the control device 601 properly controls the operations of other control target devices so that the temperature of the air which is blown into a space to be air-conditioned becomes the target blowing temperature TAO.

Concretely, with respect to the compressor 11, the control device 601 controls the refrigerant discharge capability (that is, rotational speed) of the compressor 11 so that the suctioned refrigerant pressure Ps comes close to the target suctioned refrigerant pressure PSO like in the defrosting mode of the first embodiment.

In a manner similar to the defrosting mode of the first embodiment, the control device 601 adjusts the throttle opening of the downstream expansion valve 14*g* so that the pressure difference ΔP comes close to the target pressure difference ΔPO by using the feed-forward control method.

Therefore, in the heat pump cycle 10*b* of the heating device 3, the state of the refrigerant changes like in the Mollier diagram of FIG. 13 described in the defrosting mode of the first embodiment. Therefore, the air blown from the inside blower 52 is heat-exchanged with the discharged refrigerant and heated in the inside condenser 13. When the heated blown air is blown into the space to be air-conditioned, heating of the space to be air-conditioned is realized.

According to the heating device 3 of the embodiment, an effect similar to that of the defrosting mode of the first embodiment can be obtained. That is, in the heating device 3 of the embodiment, even in the operation mode of heating the blown air using only the heat generated by the work of the compressor, the cycle can be operated stably. Moreover, the stability of the operation at the time of heating blown air as a high-pressure heating target can be improved.

The present disclosure is not limited to the foregoing embodiments and can be variously modified as follows without departing from the gist of the present disclosure.

Although the example of applying the heat pump cycle device according to the present disclosure to an air conditioner has been described in the foregoing embodiments, an object to which the heat pump cycle device is applied is not limited to an air conditioner. For example, the present disclosure may be applied to a hot-water supply device heating daily life water or the like as a heating target, a low-pressure heating target, and a high-pressure heating target.

The configuration of the heat pump cycle device according to the present disclosure not limited to the configuration disclosed in the above-described embodiments.

Although the example of employing the inside condenser 13 as a heating unit has been described in the foregoing first embodiment, the heating unit is not limited to the inside condenser 13. For example, as the heating unit, a heating unit in which a high-temperature pump, a water-refrigerant heat exchanger, a heater core, and the like are mounted in a high-temperature heating medium circulation circuit circulating a high-temperature heating medium may be employed.

The high-temperature pump is a pump which pressure-feeds a high-temperature heating medium to a water passage in a water-refrigerant heat-exchanger. As a high-temperature heating medium, a fluid of the same kind as that of the low-temperature heating medium can be employed. The water-refrigerant heat exchanger is a heat exchanger which performs heat exchange between a high-pressure refrigerant discharged from the compressor 11 and a high-temperature heating medium which is pressure-fed from the high-temperature pump. The heater core is a heat exchanger for heating, which performs heat exchange between the high-temperature heating medium heated by the water-refrigerant heat exchanger and the blown air.

The heater core is mounted in a manner similar to the inside condenser 13 in the air passage in the inside air-conditioning unit 50. In such a manner, in the hot gas heating mode or the like, the blown air as a heating target can be heated indirectly via the high-temperature heating medium by using the discharge refrigerant as a heat source.

Obviously, in place of the inside condenser 13 as the low-temperature heating unit of the second embodiment, a low-temperature heating unit using a high-temperature heating medium circulation circuit may be employed. In place of the inside condenser 13 as the high-temperature heating unit of the third embodiment, a high-temperature heating unit using a high-temperature heating medium circulation circuit may be employed.

Although the example of employing the accumulator 23 as a vapor-liquid separator having a surplus liquid-phase refrigerant in the heat pump cycle 10 has been described in the foregoing first embodiment, a receiver may be employed in place of the accumulator 23. The receiver is a high-pressure vapor-liquid separator separating vapor and liquid of the refrigerant which has flowed out from the inside condenser 13 and storing surplus liquid-phase refrigerant in the cycle.

In the case of employing a receiver in place of the accumulator 23, it is sufficient that the control device 60 controls the operation of the heating-unit-side depressurizing unit so that an overheat degree SH of the suctioned refrigerant becomes a reference overheat degree KSH which is preliminarily determined in the hot gas heating mode and the hot gas dehumidifying-heating mode.

The overheat degree SH of the suctioned refrigerant can be calculated by using the evaporator refrigerant temperature Te and the evaporator refrigerant pressure Pe detected by the evaporator refrigerant temperature-pressure sensor 62*d* or the chiller refrigerant temperature Tc and the chiller refrigerant pressure Pc detected by the chiller refrigerant temperature-pressure sensor 62*e*.

Further, it is also possible to eliminate the accumulator 23 and employ a heat exchanger of a subcooling type as the inside condenser 13. The heat exchanger of the subcooling type has a condensing unit which condenses a refrigerant, a liquid receiving unit which performs vapor-liquid separation on the refrigerant condensed by the condensing unit and stores the liquid-phase refrigerant, and a subcooling unit which subcools the liquid-phase refrigerant which has flowed out from the liquid receiving unit.

Although the example of employing the evaporation pressure regulation valve 19 constructed by a mechanical machine has been described in the foregoing first embodiment, obviously, an evaporation pressure regulation valve constructed by an electric mechanism may be employed. As an evaporation pressure regulation value having an electric mechanism, a variable throttle mechanism having a configuration similar to that of the heating expansion valve 14*a* or the like can be employed.

In the above-described embodiments, the example of employing R1234yf as the refrigerant in the heat pump cycle 10, 10*a* and 10*b* has been described, it is not limited to the example. For example, R134a, R600a, R410A, R404A, R32, R407C or the like may be employed. Alternatively, mixed refrigerants of some of those refrigerants may be employed. Further, carbon dioxide may be employed as a refrigerant to configure a supercritical refrigeration cycle in which the high-pressure refrigerant pressure becomes equal to or higher than the critical pressure of the refrigerant.

Although the example of employing ethylene glycol aqueous solution as the low-temperature heating medium and the high-temperature heating medium of the foregoing embodiments has been described, the present disclosure is not limited to the example. As the high-temperature heating medium and the low-temperature heating medium, for example, a solution containing dimethyl polysiloxane, a nanofluid, or the like, antifreeze liquid, aqueous liquid refrigerant including alcohol, a liquid medium including oil, or the like may be employed.

The control mode of the heat pump cycle device according to the present disclosure is not limited to the control modes disclosed in the above-described embodiments.

Although the air conditioner 1 for a vehicle capable of executing the various operation modes has been described in the foregoing first embodiment, all of the above-described operation modes do not have to be executable. When at least one of the hot gas heating mode, the hot gas defrosting-heating mode, the warming-up-only mode, and the defrosting mode can be executed, the stability of the cycle can be improved, and the effect of properly heating a heating target can be obtained.

In the above-described embodiments, at the time of performing the pressure difference control, the pressure difference ΔP is calculated by using the discharged refrigerant pressure Pd detected by the discharge refrigerant temperature-pressure sensor 62*a* and the suctioned refrigerant pressure Ps detected by the suction refrigerant temperature-pressure sensor 62*f*. However, the present disclosure is not limited to the calculation. For example, a value obtained by subtracting saturation pressure at the suctioned refrigerant temperature Ts from saturation pressure at the discharged refrigerant temperature Td may be used as the pressure difference ΔP.

Since the hot gas heating mode in the first embodiment is an operation mode executed at extremely low outside air temperature, it is unnecessary to cool the battery 70. There is, however, the case that warming-up of the battery 70 becomes necessary at low outside air temperature. Consequently, when the battery temperature TB becomes equal to or lower than the reference lower-limit temperature KTBL in the hot gas heating mode, a hot gas heating-warming-up mode of operating the low-temperature pump 31 and warming up the battery 70 may be executed.

Although the example of controlling the operation of the bypass flow-rate adjustment valve 14*d* so that the pressure difference ΔP comes close to the target pressure difference ΔPO in the hot gas heating mode of the foregoing first embodiment, the present disclosure is not limited to the example.

For example, the control device 60 may control the refrigerant discharge capability of the compressor 11 so that the pressure difference ΔP comes close to the target pressure difference ΔPO. In this case, it is sufficient for the control device 60 to control the operation of the bypass flow-rate adjustment valve 14*d* so that the suctioned refrigerant pressure Ps comes close to the first target suctioned refrigerant pressure PSO1. Further, it is sufficient to control the operation of the chiller expansion valve 14*c* so that the subcooling degree SC1 comes close to the first target subcooling degree SCO1.

For example, the control device 60 may control the operation of the chiller expansion valve 14*c* so that the pressure difference ΔP comes close to the target pressure difference ΔPO. In this case, it is sufficient for the control device 60 to control the refrigerant discharge capability of the compressor 11 so that the suctioned refrigerant pressure Ps comes close to the first target suctioned refrigerant pressure PSO1. Further, it is sufficient to control the operation of the bypass flow-rate adjustment valve 14*d* so that the subcooling degree SC1 comes close to the first target subcooling degree SCO1.

In the case where a receiver is employed in place of the accumulator 23, it is sufficient to adjust so that the overheat degree SH of the suctioned refrigerant becomes the reference overheat degree KSH which is preliminarily determined, by a control target device which adjusted the subcooling degree SC1.

Similar control can be employed also in the hot gas dehumidifying-heating mode. For example, the refrigerant discharge capability of the compressor 11 may be controlled so that the pressure difference ΔP comes close to the target pressure difference ΔPO in the hot gas dehumidifying-heating mode. Alternatively, in the hot gas dehumidifying-heating mode, the throttle opening of the chiller expansion valve 14*c* may be adjusted so that the pressure difference ΔP comes close to the target pressure difference ΔPO.

Although the example of controlling the operation of the upstream depressurizing unit so that the pressure difference ΔP comes close to the target pressure difference ΔPO in the warming-up-only mode of the air conditioner 1 for a vehicle of the foregoing first embodiment and in the heating device 2 of the second embodiment has been described, the present disclosure is not limited to the example.

For example, the control device 60 may control the refrigerant discharge capability of the compressor 11 so that the pressure difference ΔP comes close to the target pressure difference ΔPO. In this case, the control device 60 may control the operation of the upstream depressurizing unit so that the discharged refrigerant pressure Pd comes close to the target discharged refrigerant pressure PDO1 for the warming-up-only mode.

Although the example of controlling the operation of the downstream depressurizing unit so that the pressure difference ΔP comes close to the target pressure difference ΔPO in the defrosting mode of the air conditioner 1 for a vehicle of the foregoing first embodiment and in the heating device 3 of the third embodiment has been described, the present disclosure is not limited to the example.

For example, the control device 60 may control the refrigerant discharge capability of the compressor 11 so that the pressure difference ΔP comes close to the target pressure difference ΔPO. In this case, the control device 60 may control the operation of the downstream depressurizing unit so that the suctioned refrigerant pressure Ps comes close to the third target suctioned refrigerant pressure PSO3 for the defrosting mode.

While the present disclosure has been described with reference to embodiments thereof, it is to be understood that the disclosure is not limited to the embodiments and constructions. To the contrary, the present disclosure is intended to cover various modification and equivalent arrangements. In addition, while the various elements are shown in various combinations and configurations, which are exemplary, other combinations and configurations, including more, less or only a single element, are also within the spirit and scope of the present disclosure.

What is claimed is:

1. A heat pump cycle device comprising:

a compressor configured to compress a refrigerant and discharge the refrigerant;

a first joint configured to branch a flow of the refrigerant discharged from the compressor;

a condenser configured to heat a heating target with a heating source that is one of the refrigerants branched by the first joint;

a first valve configured to depressurize the refrigerant which has flowed out from the condenser;

a bypass passage configured to allow another of the refrigerants branched by the first joint to flow toward a suction port side of the compressor through the bypass passage;

a second valve configured to adjust a flow rate of the refrigerant passing through the bypass passage;

a second joint configured to allow the refrigerant which has flowed out from the second valve and the refrigerant which has flowed out from the first valve to mix with each other and flow toward the suction port side of the compressor; and a processor with a memory storing computer program code executable by the processor, the processor configured to determine a target pressure difference that is a target value of a pressure difference determined by subtracting a suctioned refrigerant pressure of the refrigerant drawn into the compressor from a discharge refrigerant pressure of the refrigerant discharged from the compressor, wherein an operation of at least one of the compressor, the first valve, or the second valve is controlled so that the pressure difference approaches the target pressure difference, and an operation of at least another one of the compressor, the first valve, or the second valve, which is not used for controlling the pressure difference, is controlled so that the suctioned refrigerant pressure approaches a target suctioned refrigerant pressure, in an operation mode in which the refrigerant which has flowed out from the second valve and the refrigerant which has flowed out from the first valve are directly mixed with each other.

2. The heat pump cycle device according to claim 1, wherein the processor is configured to:

control an operation of the second valve; and control the operation of the second valve so that the pressure difference approaches the target pressure difference.

3. The heat pump cycle device according to claim 2, wherein the processor is configured to estimate a throttle passage area of the second valve based on the target pressure difference and control the operation of the second valve by feed-forward control.

4. The heat pump cycle device according to claim 1, wherein the processor is configured to:

control a refrigerant discharge capability of the compressor; and control the operation of the compressor so that the suctioned refrigerant pressure approaches the target suctioned refrigerant pressure.

5. A heat pump cycle device comprising:

a compressor configured to compress a refrigerant and discharge the refrigerant;

a first joint configured to branch a flow of the refrigerant discharged from the compressor;

a condenser configured to heat a heating target with a heating source that is one of the refrigerants branched by the first joint;

a first valve configured to depressurize the refrigerant which has flowed out from the condenser;

a bypass passage configured to allow another of the refrigerants branched by the first joint to flow toward a suction port side of the compressor through the bypass passage;

a second valve configured to adjust a flow rate of the refrigerant passing through the bypass passage;

a second joint configured to allow the refrigerant which has flowed out from the second valve and the refrigerant which has flowed out from the first valve to mix with each other and flow toward the suction port side of the compressor;

a processor with a memory storing computer program code executable by the processor, the processor configured to:

determine a target pressure difference that is a target value of a pressure difference determined by subtracting a suctioned refrigerant pressure of the refrigerant drawn into the compressor from a discharge refrigerant pressure of the refrigerant discharged from the compressor;

control an operation of the second valve;

control the operation of the second valve so that the pressure difference approaches the target pressure difference; and estimate a throttle passage area of the second valve based on the target pressure difference and control the operation of the second valve by feed-forward control.

6. The heat pump cycle device according to claim 1, wherein the processor is configured to:

determine a target temperature of the heating target; and determine the target pressure difference so as to increase as the target temperature rises.

* * * * *